US011833098B1

(12) United States Patent
Keiser

(10) Patent No.: US 11,833,098 B1
(45) **Date of Patent: *Dec. 5, 2023**

(54) SYSTEM AND METHOD FOR KNEE REHABILITATION

(71) Applicant: Darren Keiser, Gretna, NE (US)

(72) Inventor: Darren Keiser, Gretna, NE (US)

( * ) Notice: Subject to any disclaimer, the term of this patent is extended or adjusted under 35 U.S.C. 154(b) by 219 days.

This patent is subject to a terminal disclaimer.

(21) Appl. No.: 15/960,031

(22) Filed: Apr. 23, 2018

Related U.S. Application Data

(63) Continuation-in-part of application No. 13/606,334, filed on Sep. 7, 2012, now Pat. No. 9,949,885.

(51) Int. Cl.

| | |
|---|---|
| ***A61H 1/02*** | (2006.01) |
| ***A63B 22/00*** | (2006.01) |
| ***A63B 23/035*** | (2006.01) |
| ***A63B 23/04*** | (2006.01) |

(52) U.S. Cl.
CPC ..... *A61H 1/024* (2013.01); *A61H 1/0255* (2013.01); *A61H 2001/0207* (2013.01); *A61H 2201/0157* (2013.01); *A61H 2201/0161* (2013.01); *A61H 2201/0192* (2013.01); *A61H 2201/1269* (2013.01); *A61H 2203/0431* (2013.01); *A63B 23/03508* (2013.01); *A63B 23/0494* (2013.01); *A63B 2022/0094* (2013.01)

(58) Field of Classification Search
CPC ..... A61H 23/02; A61H 2203/0437; A61H 2203/0425; A61H 2203/0431; A61H 2205/106; A61H 1/005; A61H 3/0244; A61H 2201/0134; A61H 2201/0157; A61H 2201/0161; A47C 16/025; A47C 1/022; A47C 1/024; A47C 1/0242; A47C 1/031; A47C 1/03211; A47C 1/034; A47C 3/26; A47C 3/34; A47C 4/04; A47C 4/10; A63B 23/03508; A63B 23/04; A63B 2023/006; A63B 21/00047; A63B 5/12; A63B 1/00; A63B 2208/0228; A63B 2208/0233
USPC ..... 108/134, 135; 601/34
See application file for complete search history.

(56) References Cited

U.S. PATENT DOCUMENTS

| | | | | | |
|---|---|---|---|---|---|
| 2,723,855 | A * | 11/1955 | McKee | A63B 25/00 | 482/77 |
| 4,304,401 | A | 12/1981 | Goodman | | |
| 4,784,121 | A | 11/1988 | Brooks | | |
| 5,074,549 | A | 12/1991 | Harvey | | |
| 5,290,209 | A | 3/1994 | Wilkinson | | |
| 5,478,034 | A * | 12/1995 | Cunningham | A47C 16/00 | 248/118.5 |
| 5,538,487 | A | 7/1996 | Fulmer | | |
| 5,643,181 | A * | 7/1997 | Lin | A61H 15/0078 | 601/112 |
| 5,656,002 | A | 8/1997 | Dittmeier | | |

(Continued)

*Primary Examiner* — Justine R Yu
*Assistant Examiner* — Alexander Morales
(74) *Attorney, Agent, or Firm* — Suiter Swantz. pc llo

(57) ABSTRACT

The invention may be embodied in a physical therapy or health maintenance stretching system including a frame configured for engaging a treated leg of a user at or near the popliteal space of the treated leg to allow a knee of the treated leg to bend inwards in response to gravitational force affecting a lower portion of the treated leg. The frame may be further configured to allow a knee of the treated leg to bend inwards in response to a user force directly or indirectly applied to the lower portion of the treated leg.

15 Claims, 19 Drawing Sheets

(56) References Cited

U.S. PATENT DOCUMENTS 5,720,699 A 2/1998 Musachio et al.
5,772,563 A 6/1998 Lin
6,165,112 A 12/2000 Morris
6,203,473 B1 * 3/2001 Atwood ..... A63B 21/00047 482/142
6,220,995 B1 * 4/2001 Chen ..... A63B 21/02 601/24
6,254,517 B1 * 7/2001 Kennedy ..... A63B 21/0552 482/121
6,432,029 B1 * 8/2002 Almeda ..... A63B 21/00047 482/142
8,870,715 B2 10/2014 Stiles
9,498,399 B1 * 11/2016 Juntunen ..... A61H 1/024
2003/0004042 A1 * 1/2003 Burrell ..... A63B 21/00047 482/121
2005/0159688 A1 * 7/2005 Sakamoto ..... A61H 15/0092 601/123
2005/0187083 A1 * 8/2005 Krystoff ..... A63B 21/00047 482/96
2006/0252616 A1 * 11/2006 Gerschefske ..... A63B 21/055 482/142
2006/0258516 A1 11/2006 Nolte
2008/0058173 A1 * 3/2008 Mattox ..... A63B 21/0004 482/92
2008/0182730 A1 * 7/2008 Conley ..... A61H 1/0244 482/95
2009/0017995 A1 * 1/2009 Freiberg ..... A61H 1/024 482/91
2010/0221974 A1 * 9/2010 Monaghan ..... A63B 21/02 601/24
2011/0046525 A1 2/2011 Stiles
2011/0053738 A1 * 3/2011 Osbourne ..... A63B 23/0355 482/122
2011/0137215 A1 * 6/2011 LeBlanc ..... A61H 1/024 601/5
2013/0110013 A1 5/2013 Carlson et al.
2013/0197403 A1 * 8/2013 Sevy ..... A63B 21/0442 601/5
2013/0211297 A1 * 8/2013 Method ..... A61H 1/024 601/34
2013/0225378 A1 * 8/2013 Burek ..... A63B 23/0216 482/142
2016/0279011 A1 * 9/2016 Lutz ..... A61H 1/024
2016/0367427 A1 * 12/2016 Malone ..... A61H 1/024
2017/0007495 A1 * 1/2017 Norwood ..... A61H 15/0092
2017/0020771 A1 * 1/2017 Shannon ..... A63B 23/0355 482/122
2019/0142679 A1 * 5/2019 Kramer ..... A63B 21/4034 601/34

* cited by examiner

SYSTEM AND METHOD FOR KNEE REHABILITATION

CROSS-REFERENCE TO RELATED APPLICATIONS

The present application claims priority under 35 U.S.C. § 120 as a continuation-in-part of co-pending U.S. patent application Ser. No. 13/606,334, filed Sep. 7, 2012, entitled SYSTEM AND METHOD FOR KNEE REHABILITATION. Said U.S. patent application Ser. No. 13/606,334 is herein incorporated by reference in its entirety.

TECHNICAL FIELD

The present disclosure generally relates to the field of joint therapy and more particularly to a system and method for improving knee mobility.

BACKGROUND

The progress of medical science has led to a variety of medical treatments for injuries and/or diseases affecting human joints. In particular, surgical procedures, such as anterior cruciate ligament (ACL) reconstruction, knee arthroscopy, fracture repair (operative and nonoperative), total knee replacement, and the like, are often performed to treat joint and ligament injuries or diseases affecting knee mobility. A pre-surgery injury or disease as well as the surgery itself often causes the natural motion of the knee to be impaired as a result of muscular swelling, scar tissue, and any other muscular, nervous, or tissue ailment resulting from pre-surgical or surgical trauma.

Physical therapy is commonly provided for a patient having undergone a surgical procedure or other medical treatment affecting knee mobility to restore at least a portion of the natural motion of the patient's knee. If the physical therapy is unsuccessful at rehabilitating the knee, the patient may indefinitely suffer from a limited range of motion and/or a stiff leg caused by improper healing. It is, therefore, desirable to provide physical therapy to improve knee mobility for patients in a comfortable and easily accessible setting.

SUMMARY

The present disclosure is directed to a system and method for improving knee mobility of a user having undergone medical treatment for injury or disease affecting at least one of the user's knees.

In one aspect, the present disclosure is directed to a system for improving knee mobility after medical treatment for injury or disease, including: a support mechanism disposed proximate to a surface of a floor, the support mechanism configured for receiving a user having undergone medical treatment affecting knee mobility; and a substantially rectangular frame, said frame having a predetermined width corresponding to a waist size of the user, said frame including a top member having a padded portion, the padded portion of the top member configured for engaging a treated leg of the user at or near the popliteal space of the treated leg to support a thigh of the treated leg, allowing an extension of the thigh of the treated leg and the floor intersect at an angle in the range of 20 to 90 degrees, said frame further including two side members disposed substantially perpendicular to the thigh of the treated leg, said frame configured for inducing a knee of the treated leg of the user to bend inwards in response to gravitational force affecting a lower portion of the treated leg.

In another aspect, the present disclosure is directed to a system for improving knee mobility after medical treatment for injury or disease, including: a support mechanism disposed at an elevation in the approximate range of 15 to 40 inches from a surface of a floor, the support mechanism configured for receiving a user having undergone medical treatment affecting knee mobility; and a frame, said frame including a top member configured for engaging a treated leg of the user at or near the popliteal space of the treated leg to support a thigh of the treated leg, allowing an extension of the thigh of the treated leg and the floor intersect at an angle in the range of 20 to 90 degrees, said frame further including two side members, substantially parallel to one another, intersecting the floor at an angle in range of 40 to 80 degrees, said frame configured for inducing a knee of the treated leg of the user to bend inwards in response to gravitational force affecting a lower portion of the treated leg.

In another aspect, the present disclosure is directed to a method of improving knee mobility of a user having undergone medical treatment, including the steps of: providing a substantially rectangular frame, said frame having a predetermined width corresponding to a waist size of a user, said frame including a top member having a padded portion, the padded portion of the top member configured for engaging a treated leg of the user at or near the popliteal space of the treated leg to support a thigh of the treated leg, allowing an extension of the thigh of the treated leg and the floor intersect at an angle in the range of 20 to 90 degrees, said frame further including two side members disposed substantially perpendicular to the thigh of the treated leg; engaging the popliteal space of the treated leg of the user with a portion of the padded portion of the top member of the rectangular frame; and facilitating utilization of gravitational force to actuate a lower portion of the treated leg of the user to bend a knee of the treated leg inwards.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

FIGS. 1 through 13 generally illustrate a system and method for improving knee mobility, such as flexion, extension, rotation, range of motion, ease of motion, and the like. A patient having an injury or disease affecting knee mobility may undergo a medical treatment, such as ligament reconstruction, total knee replacement, fracture repair, or any other surgical or therapeutic treatment to alleviate the injury or disease. However, the medical treatment and/or the corresponding injury or disease may impair the patient's ability to move his or her knee. Accordingly, a system and method are provided to restore at least a portion of the knee mobility of the patient that existed before the patient was affected by the injury, disease, or medical treatment.

It is further contemplated that the system and method provided herein may be utilized to improve knee mobility for any individual regardless of whether or not the individual has impaired knee mobility. For example, the system and method provided herein may be utilized for athletic training. Alternatively, the system and method may be utilized to maintain existing knee mobility. The foregoing examples are merely included for illustrative purposes to demonstrate that the present disclosure may be extended to uses beyond providing physical therapy after medical treatment for injury or disease affecting knee mobility.

Figure 1:
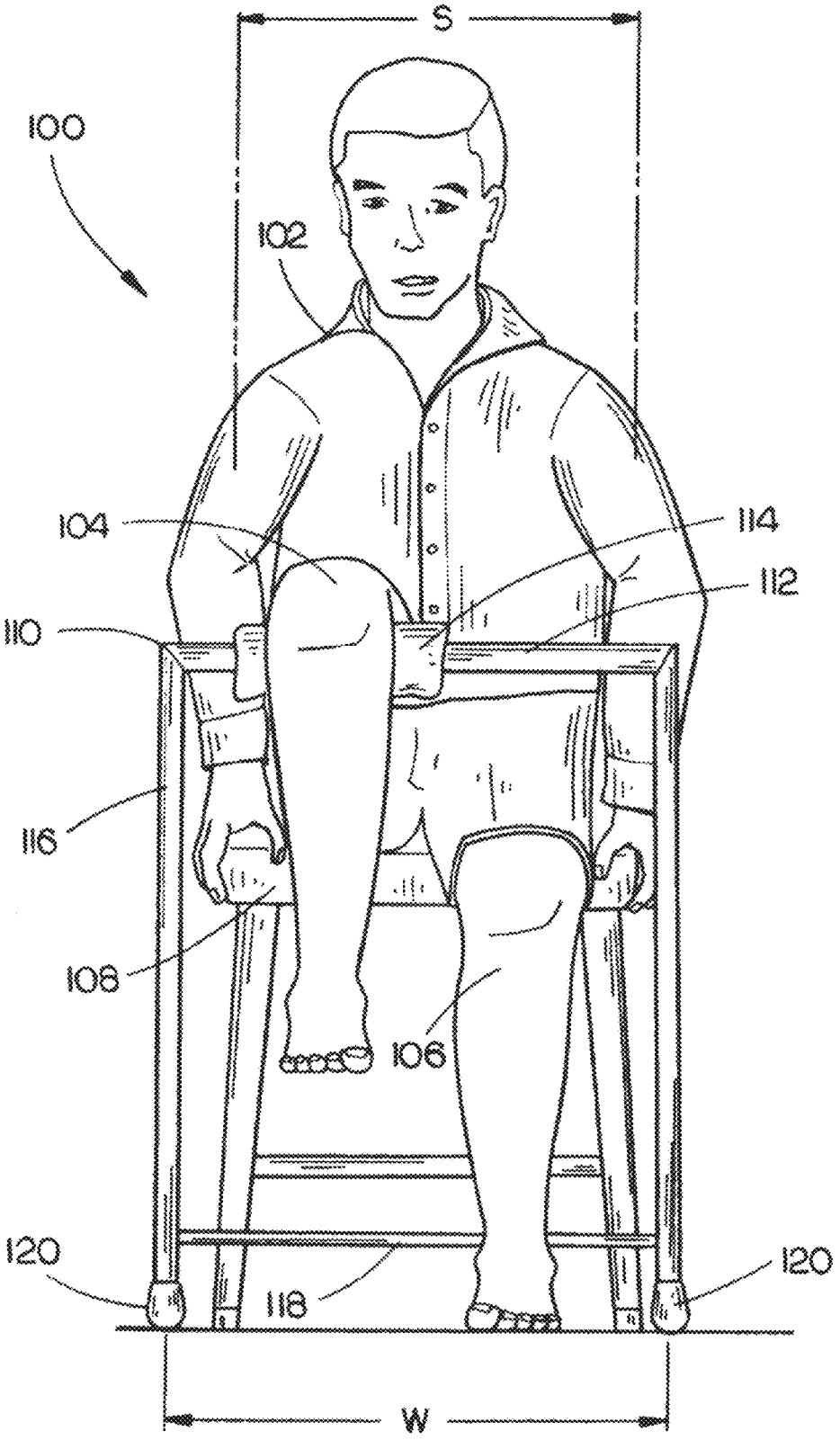
FIG. 1 is a front view illustrating a system for improving knee mobility after medical treatment for injury or disease.
Figure 2:
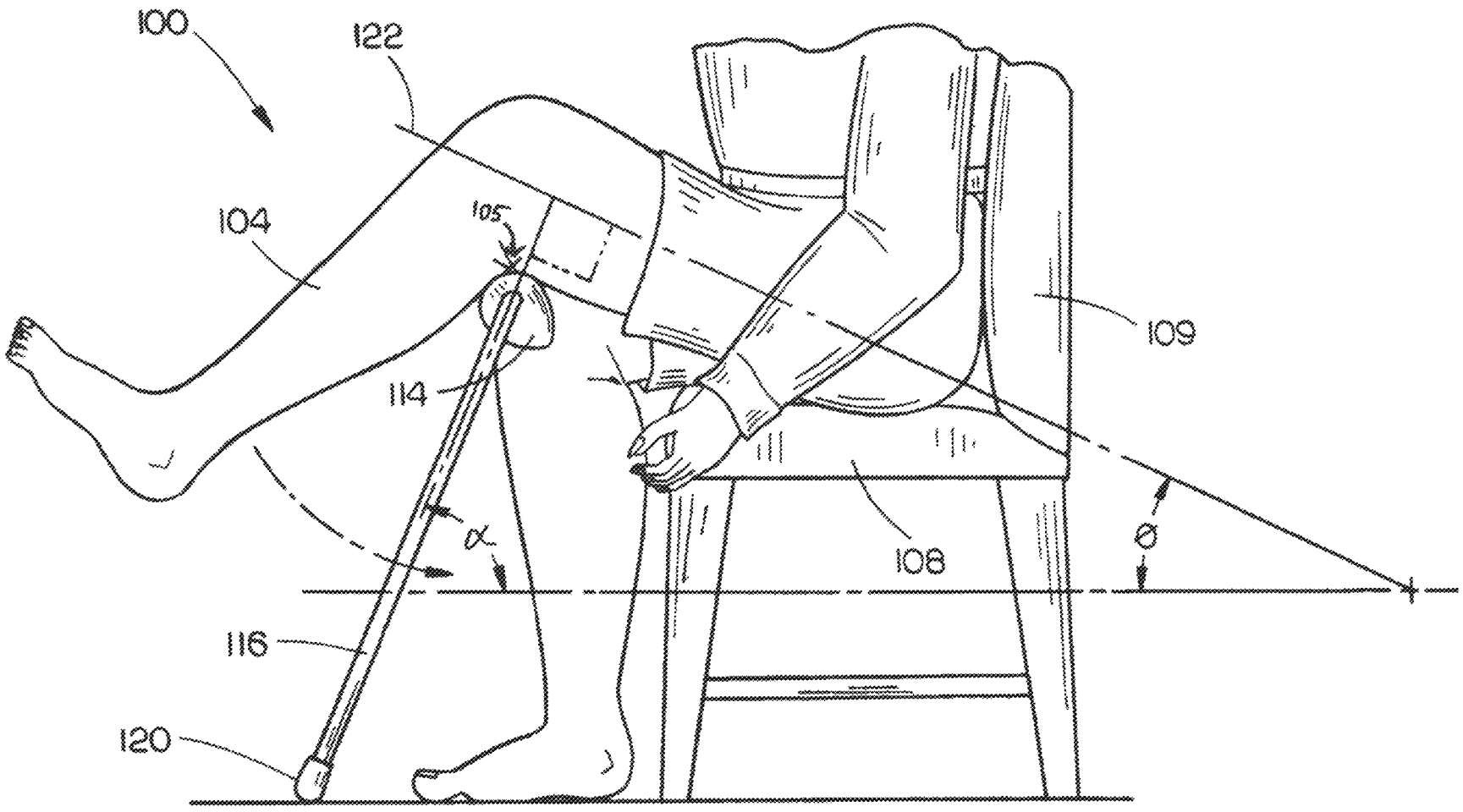
FIG. 2 is a partial side view of the system illustrated in FIG. 1.

FIGS. 1 and 2 illustrate a system 100 for improving knee mobility of a user 102 having undergone medical treatment for injury or disease affecting knee mobility in at least one treated leg 104 of the user 102. The system 100 may be utilized by the user 102 to engage in physical therapy to regain or improve knee mobility in the treated leg 104. It is contemplated that the system 100 may allow the user 102 to perform physical therapy in a variety of settings, such as a hospital, physical therapy center, home, and the like. Although the following discussion pertains to treating one leg of the user 104 while maintaining a resting (untreated) leg 106 disposed in a comfortable position, it is further contemplated that the system 100 could be extended to treating both legs 104 and 106 of the user 102, as would be recognized by all those skilled in the art.

The system 100 may include a support mechanism 108 configured for receiving the user 102 having undergone medical treatment affecting knee mobility. The support mechanism 108 may include a platform configured to support the user 102 in multiple locations, such as on a mat, padded or cushioned surface, bed, chair, or any other support structure. The support mechanism 108 may be disposed proximate to a surface of a floor, either in direct contact with the floor or at an elevation from the floor. For example, the support mechanism 108 may include a chair having an elevation in the range of approximately 15 to 40 inches from the surface of the floor.

The support mechanism 108 may optionally include a rear support member 109 configured for supporting the user's back to alleviate pressure on the user's spine. The rear support member 109 may be positioned at a substantially 90 degree angle from the floor to support the user 102 in a substantially upright position. Alternatively, the rear support member 109 may be positioned at an acute angle from the floor to support the user 102 in a reclined position. In some embodiments, the rear support member 109 may be further configured to adjust to a plurality of positions, allowing the user 102 or another person (e.g. doctor, nurse, physical therapist, medical aid, trainer, etc.) to position the rear support member 109 to a desired angle from the floor.

The system 100 may further include a frame 110 configured for engaging the treated leg 104 of the user 102 to allow flexion of the treated leg 104 in response to gravitational and/or user forces. The frame 110 may include a top member 112 configured for substantially engaging the treated leg 104 at or near the popliteal space 105 of the treated leg 104. For example, the top member 112 may be configured for engaging a region behind the knee or at the back part of the thigh of the treated leg 104. The frame 110 may further include two side members 116, each being coupled to an end of the top member at a substantially 90 degree angle. The two side members 116 may be configured to elevate the top member 112 to support the knee of the treated leg 104 at an elevation from the floor. The frame 110 may further include a bottom member 118 disposed parallel to the top member 112 in between the two side members 116. Each of the two side members 116 may be further coupled to an end of the bottom member 118 at a substantially 90 degree angle, such that the top member 112, the two side members 116, and the bottom member 118 form a substantially rectangular structure. The bottom member 118 may be configured to hold together the two side members 116 to provide structural support for the frame 110 as a whole.

In one embodiment, the frame 110 may be a substantially rectangular frame having a predetermined width W corresponding to a waist size S of the user 102. The width W may be defined as a distance in between the two side members 116 of the frame 110, a length of the top member 112 of the frame 110, or any dimension defining a portion of the frame 110 configured for engaging the treated leg 104 of the user 102. The waist size S of the user 102 may be defined as the width of the user's waist, a distance across the user's midriff substantially measured from the user's left hip to the user's right hip, a distance separating the user's hips, or any other body dimension associated with the perimeter, width, or depth of the user's waist.

In a further embodiment, the frame 110 may have a selected width W chosen from a plurality of standardized width dimensions. For example, the width W of the frame 110 may be selected from a plurality of standard sizes (e.g.

Small, Medium, Large, Extra-large) associated with a plurality of width W dimensions. Accordingly, an appropriately sized frame 110 may be specified for the user 102 based upon the waist size S of the user 102.

As illustrated in FIG. 2, the two side members 116 of the frame 110 may be positioned at a substantially 90 degree angle relative to a thigh of the treated leg 104 of the user 102. Disposing the two side members 116 substantially perpendicular to the thigh of the treated leg 104 may enable the top member 112 to provide support for the thigh of the treated leg 104 while allowing a lower portion of the treated leg 104 below the knee to hang limply. Accordingly, the frame 110 may be configured for allowing the lower portion of the treated leg 104 to be actuated by gravitational force, causing flexion of the knee of the treated leg 104, whereby the knee bends inwards in a motion causing the angle between the thigh and the lower portion of the treated leg 104 to be reduced.

The frame 110 may be further configured to support the knee of the treated leg 104 at an elevation so that the thigh of the treated leg 104 is held at an angle θ from the floor. For example, a conceptual extension 122 of the thigh may intersect the floor at an angle θ in the range of approximately 20 to 90 degrees. The two side members 116 of the frame 110 may be further configured to intersect the floor at an angle α in order to maintain a perpendicular alignment between the two side members 116 of the frame 110 and the thigh of the treated leg 104 while allowing the thigh to be supported at an elevated angle θ. For example, the angle α between the two side members 116 and the floor may be in the range of approximately 40 to 80 degrees.

The frame 110 may be configured to maintain the substantially perpendicular alignment of the two side members 116 relative to the thigh of the treated leg 104 in addition to keeping the thigh at the elevated angle θ because doing so may allow gravitational force to actuate the lower portion of the treated leg 104. Increasing the angle θ of elevation of the thigh from the floor may facilitate improved actuation of the lower portion of the treated leg 104 utilizing gravitational force. In addition, the perpendicular alignment of the two side members 116 relative to the thigh of the treated leg 104 may provide improved support of the thigh of the treated leg 104, thereby reducing strain on muscles of the treated leg 104 and allowing the lower portion of the treated leg 104 to hang limply subject to actuation by gravitational force.

In one embodiment, frame 110 may be configured to engage the treated leg 104 of the user 102 to form a substantially right triangle having sides delineated by the conceptual extension 122 of the thigh, the two side members 116, and the floor. Accordingly, the angle θ between the floor and the conceptual extension of the thigh of the treated leg 104 and the angle α between the two side members 116 and the floor may have values necessary to form said substantially right triangle.

Figure 3:
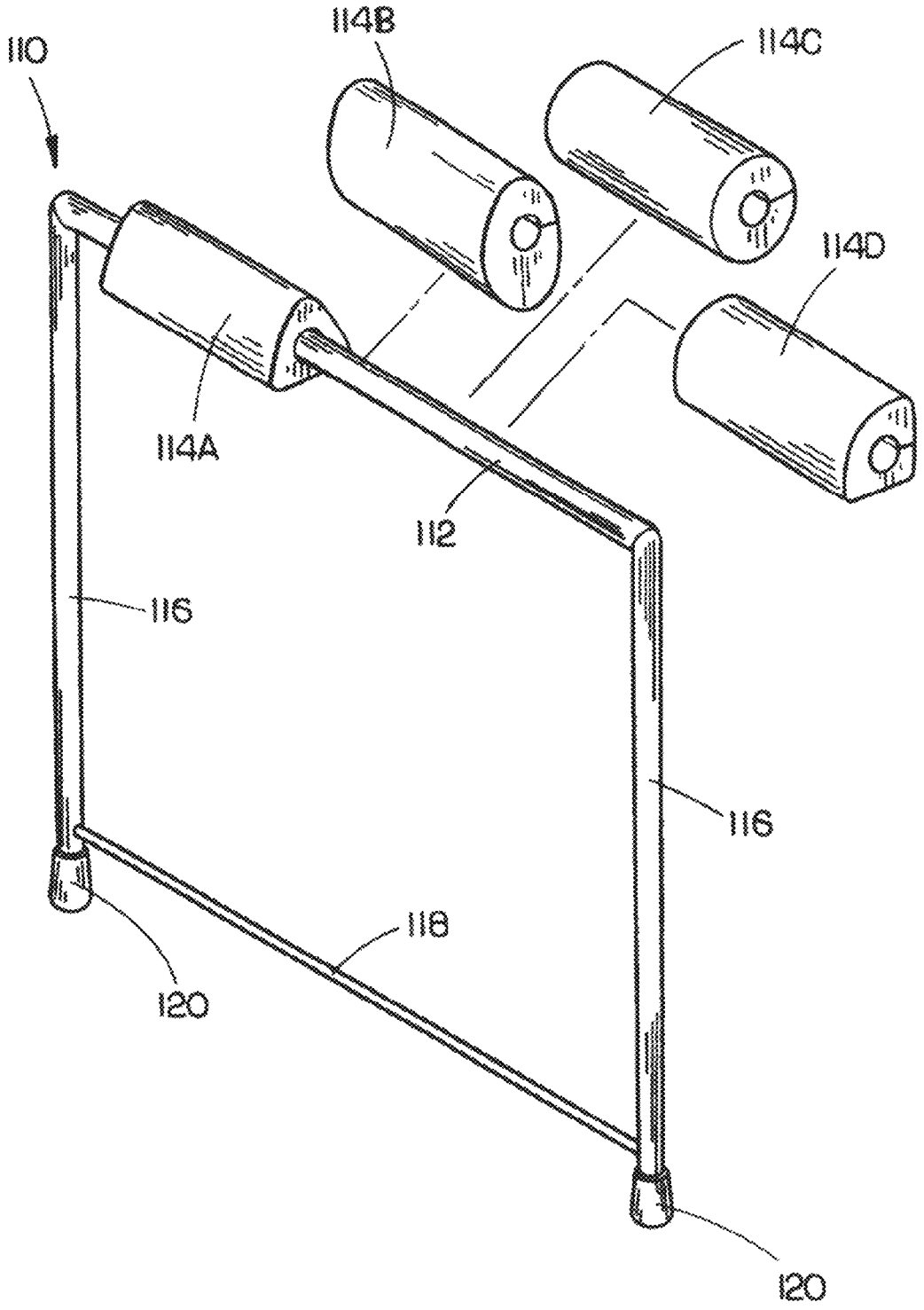
FIG. 3 is an isometric view of the frame of the system illustrated in FIG. 1.
Figure 4:
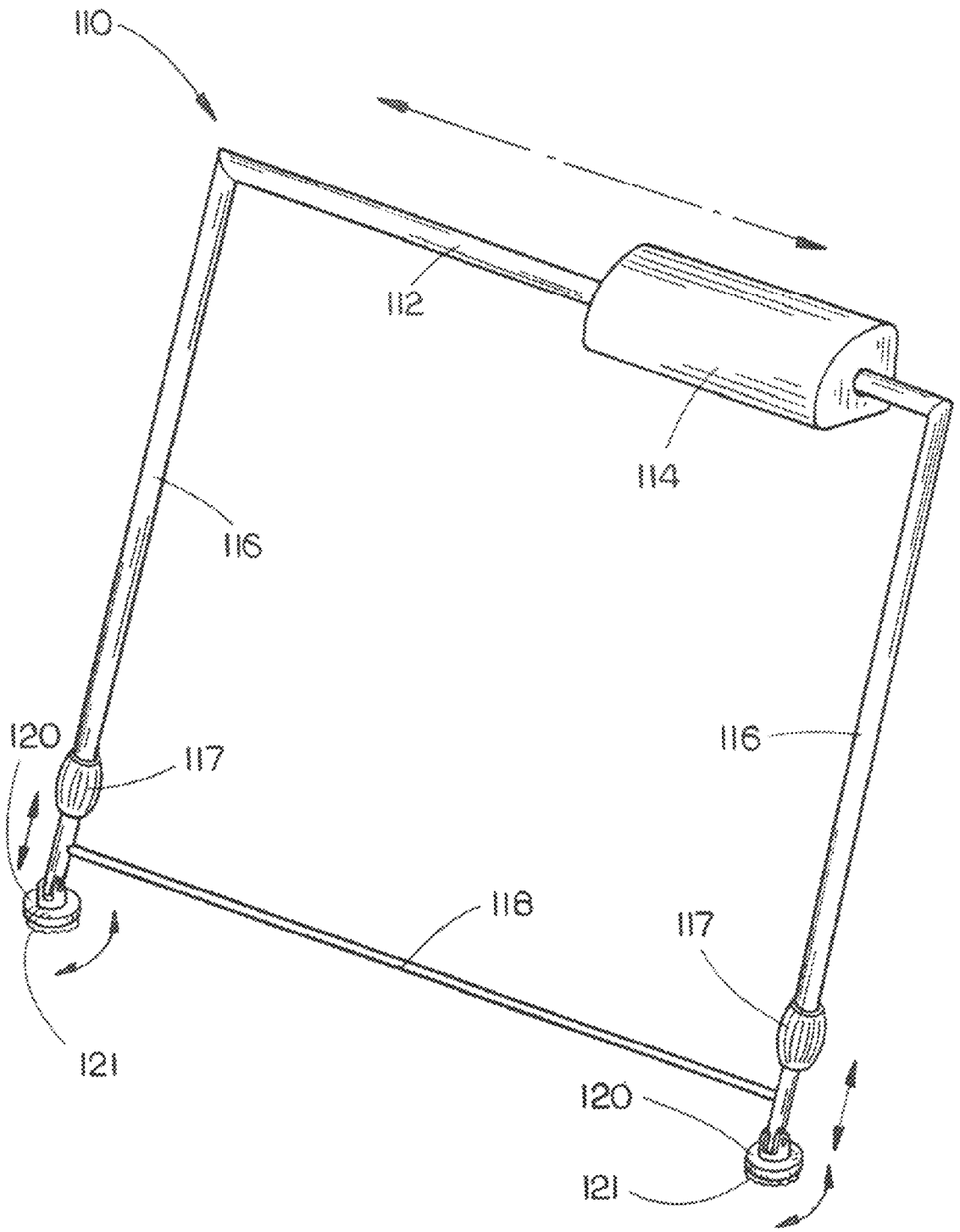
FIG. 4 is an isometric view of the frame of the system illustrated in FIG. 1.
Figure 5:
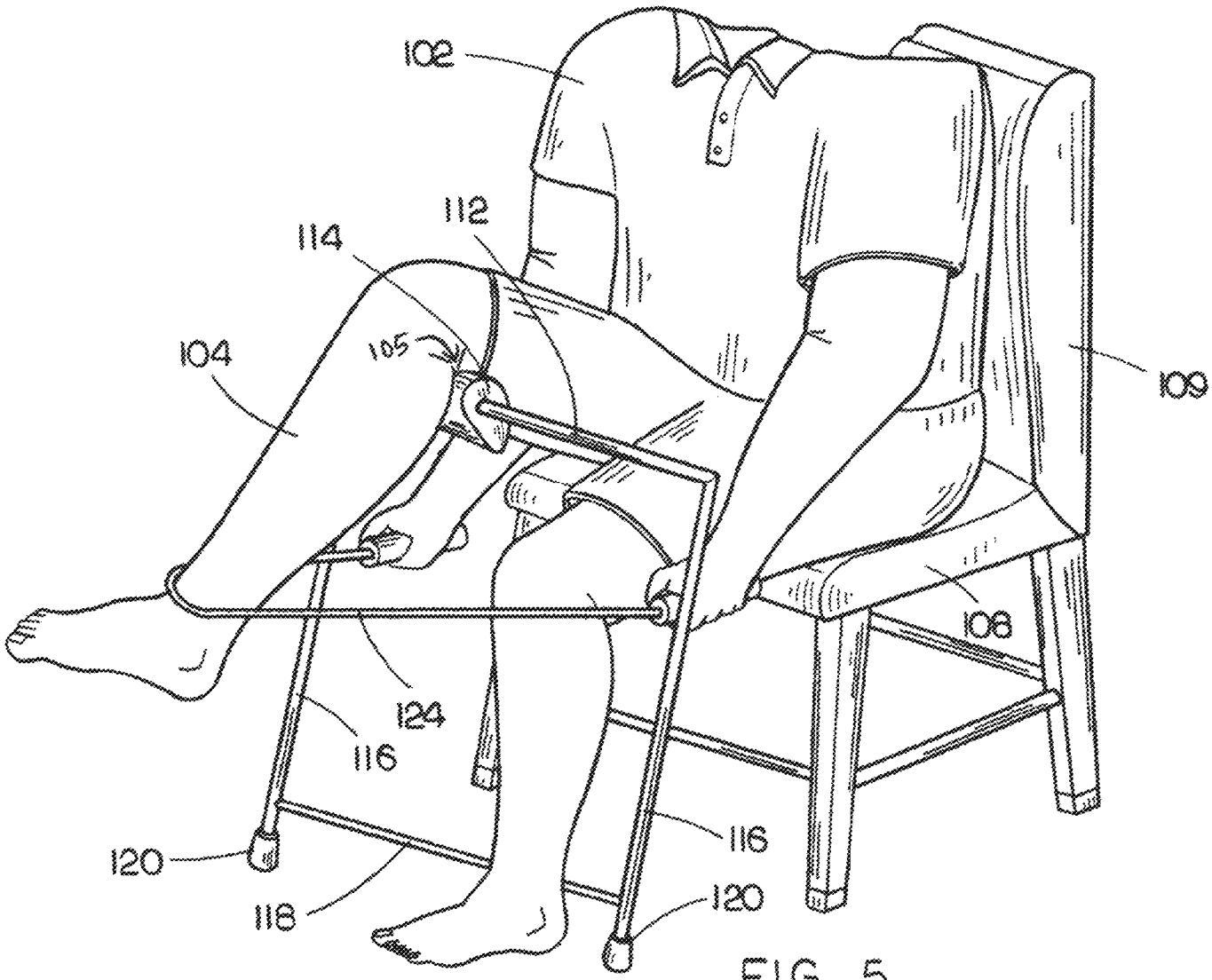
FIG. 5 is an isometric view of the system in FIG. 1, including a strap configured for engaging a lower portion of a treated leg of a user.
Figure 6:
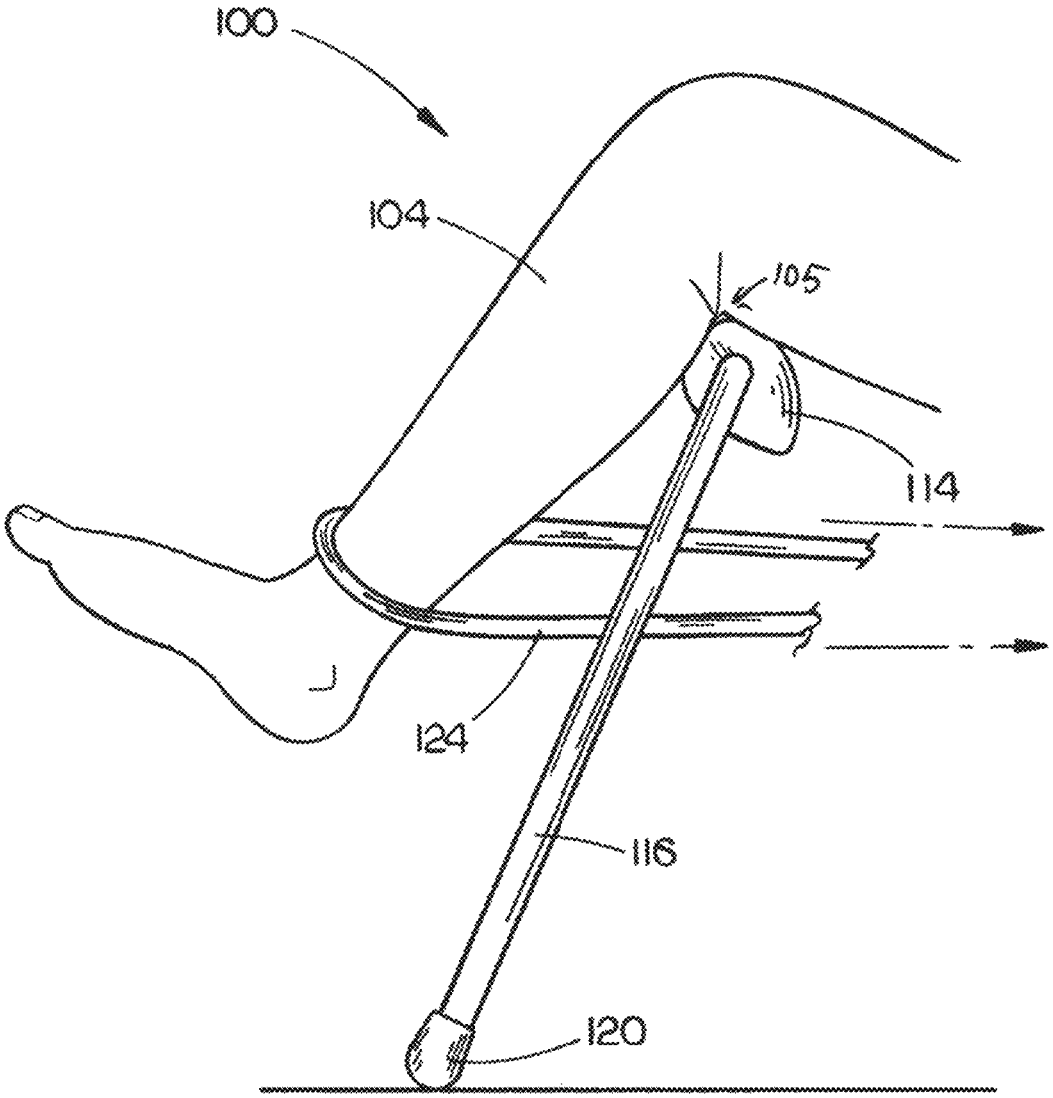
FIG. 6 is a partial side view of the system illustrated in FIG. 5.

FIGS. 3 and 4 are illustrative of some alternative embodiments of the frame 110. For example, in one embodiment the top member 112 of the frame 110 may include a padded portion 114 extending along at least a portion of the top member 112. The padded portion 114 may be a fabricated portion of the top member 112. Alternatively, the padded portion 114 may be permanently attached to the top member 112. Alternatively, the padded portion 114 may be removably attached to the top member 112. The padded portion 114 of the top member 112 may be configured to engage the treated leg 104 at or near the popliteal space 105 of the treated leg 104 of the user 102. The padded portion 114 of the top member 112 may provide improved comfort and/or traction for the user 102 utilizing the frame 110 for a physical therapy session.

In one embodiment, shown in FIG. 3, the padded portion 114 of the top member 112 may include a deformable or flexible material, such as rubber foam or a deformable container bearing a liquid or semisolid substance, such as a gel pack. Alternatively, the padded portion 114 of the top member 112 may include a rigid material, such as plastic or metal, ergonomically shaped to cradle the treated leg 104. For example, the padded portion 114 may include a C-shaped catch (cradle) coupled to the top member 112 with a hinge allowing the padded portion 114 to freely rotate around the top member 112 to accommodate user movement and/or multiple positions of the frame 110.

The padded portion 114 may be selected from a variety of shapes and/or sizes. The padded portion 114 may be ergonomically shaped to provide comfort for specified user attributes and/or therapies. The padded portion 114 may be configured to fit snugly around a portion of the top member 112. For example, the padded portion 114 may include an opening configured to receive a portion of the top member 112 snugly. In addition, the padded portion 114 may include a slit along the length of the padded portion 114 configured for removably attaching the padded portion 114 to the top member 112. It is further contemplated that the padded portion 114 may be permanently or removably attached to the top member 112 via alternative fastening means such as an adhesive fastener, a button, a belt, a VELCRO fastener, and the like.

In one embodiment, shown in FIG. 4, the frame 110 may include adjustable features. For example, the frame 110 may be configured to have adjustable dimensions, such as height and width. It is contemplated that the frame 110 may have means for adjusting the height or width incorporated into the top member 112, the two side members 114, and/or the bottom member 118, respectively. For example, the frame 110 may include interlocking segments, telescopic segments 117, or any other adjustable means known to the art. In addition the padded portion 114 may be translatable to a plurality of positions along the top member 112. For example, the padded portion 114 may be translated from one side of the top member 112 to another side in order to accommodate treatment of the user's right or left leg. Alternatively, the padded portion 114 may be positioned at alternative positions along the top member 112 by attachment to a plurality of locations along the top member 112 configured to receive the padded portion 114.

In one embodiment, the frame 110 may further include end members 120 configured for engaging the floor to stabilize the frame 110. The end members 120 may include bases 121 and/or hinges configured to provide traction between the end members 120 and the floor. The end members 120 may be further configured to pivot to a plurality of angles from the floor. In one embodiment, the end members 120 may include bases 121 to provide traction and hinges configured to pivot to a plurality of angles, allowing the bases 121 to maintain a flat contact with the floor and simultaneously allowing the frame to be positioned at one or more angles from the floor.

In one embodiment, the frame 110 may be further configured to collapse into a portable form for convenient transportation. For example, the frame 110 may be configured to disassemble into multiple segments. Alternatively, the frame 110 may include hinges separating one or more segments of the frame 110 (e.g. between the top, side, and bottom members) allowing the frame 110 to be collapsed upon itself into a portable form. Alternatively, the frame 110 may include telescopically connected segments like those often utilized in handles of luggage bags, allowing the frame 110 to be collapsed into a portable form. It is further contemplated that other collapsible devices known to the art may be included to make the frame 110 portable without departing from the present disclosure.

It is further contemplated that the frame 110 may also be configured for engaging a portion of the treated leg 104 behind an ankle of the treated leg 104. The padded portion 114 of the top member 112 of the frame 110 may be configured for supporting the ankle of the treated leg 104 at an elevation so that the treated leg 104 is extended. Accordingly, the frame 110 may be configured for improving knee mobility of the treated leg 104 by allowing extension for a desired period of time. Thus, the frame 110 may be configured for enhancing both knee flexion and extension.

FIGS. 5 through 8 illustrate various means by which the user 102 may apply additional force to the lower portion of the treated leg 104. In one embodiment, shown in FIGS. 5 and 6, the system 100 may include a strap 124 configured for engaging the lower portion of the treated leg 104. For example, the strap 124 may engage the lower portion of the treated leg 104 near the ankle of the treated leg. The strap 124 may be further configured to actuate the treated leg 104 so that the knee is forced to bend inwards as a result of the user 102 applying a force, such as a pulling force, to the strap 124.

Figure 7A:
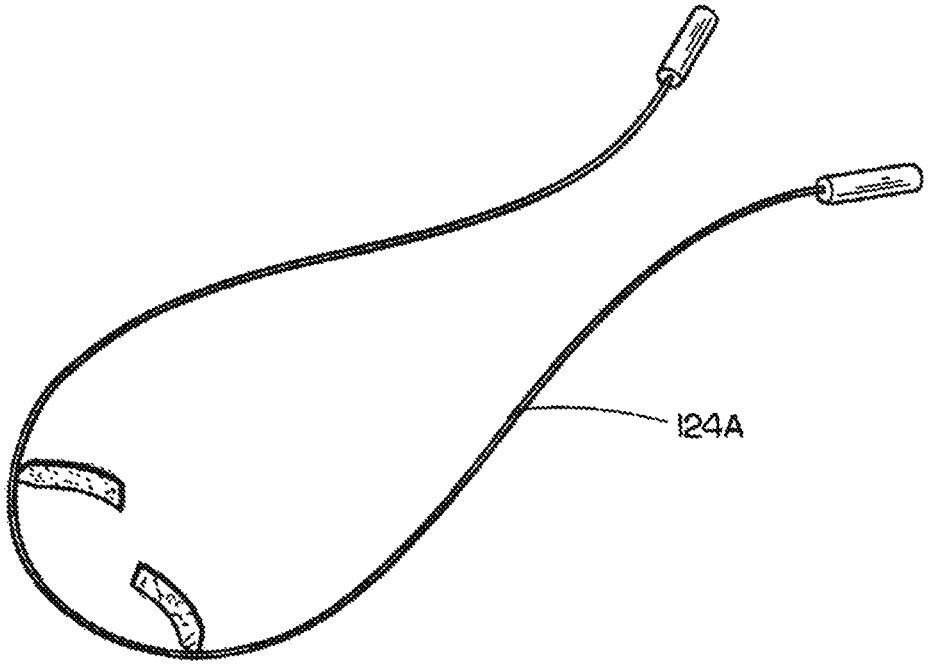
FIG. 7 is a top view illustrating multiple embodiments of the strap of the system illustrated in FIG. 5.
Figure 7B:
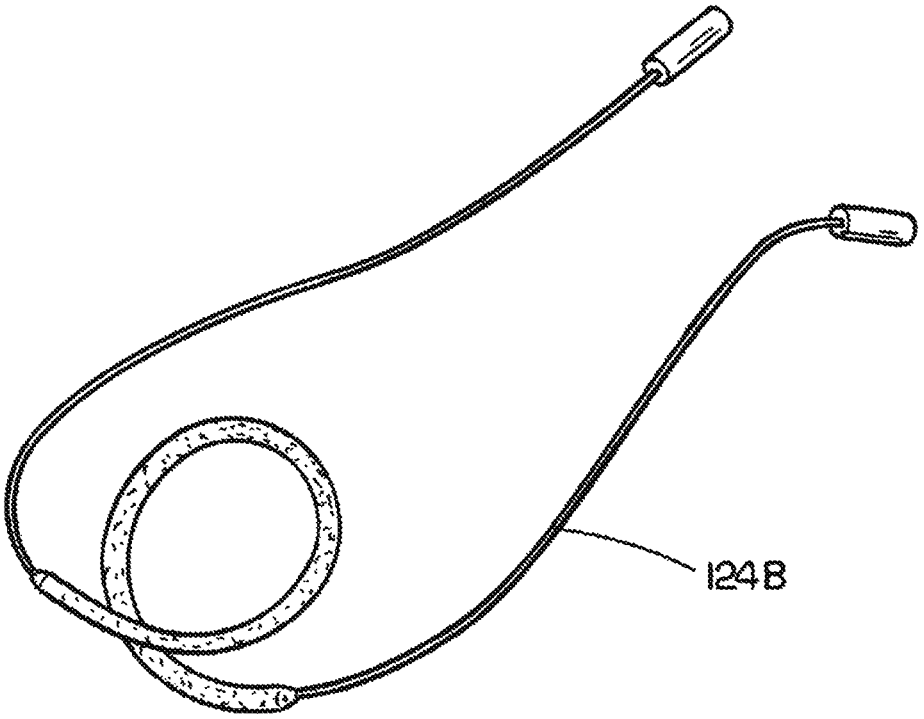

FIG. 7 illustrates exemplary embodiments of the strap 124; however, it is contemplated that the strap 124 may be significantly altered from the embodiments described herein without departing from the present disclosure. In one embodiment, the strap 124 may include a fastener configured to maintain snug contact between the strap 124 and the lower portion of the treated leg 104. Alternatively, the strap 124 may be configured to completely encircle a portion of the lower portion of the treated leg 104 to maintain snug contact between the strap 124 and the lower portion of the treated leg 104. In a further embodiment, the strap 124 may have appropriate dimensions based on body dimensions of the user 102 to enable the user 102 to actuate the strap 124 while maintaining a substantially upright position.

Figure 8:
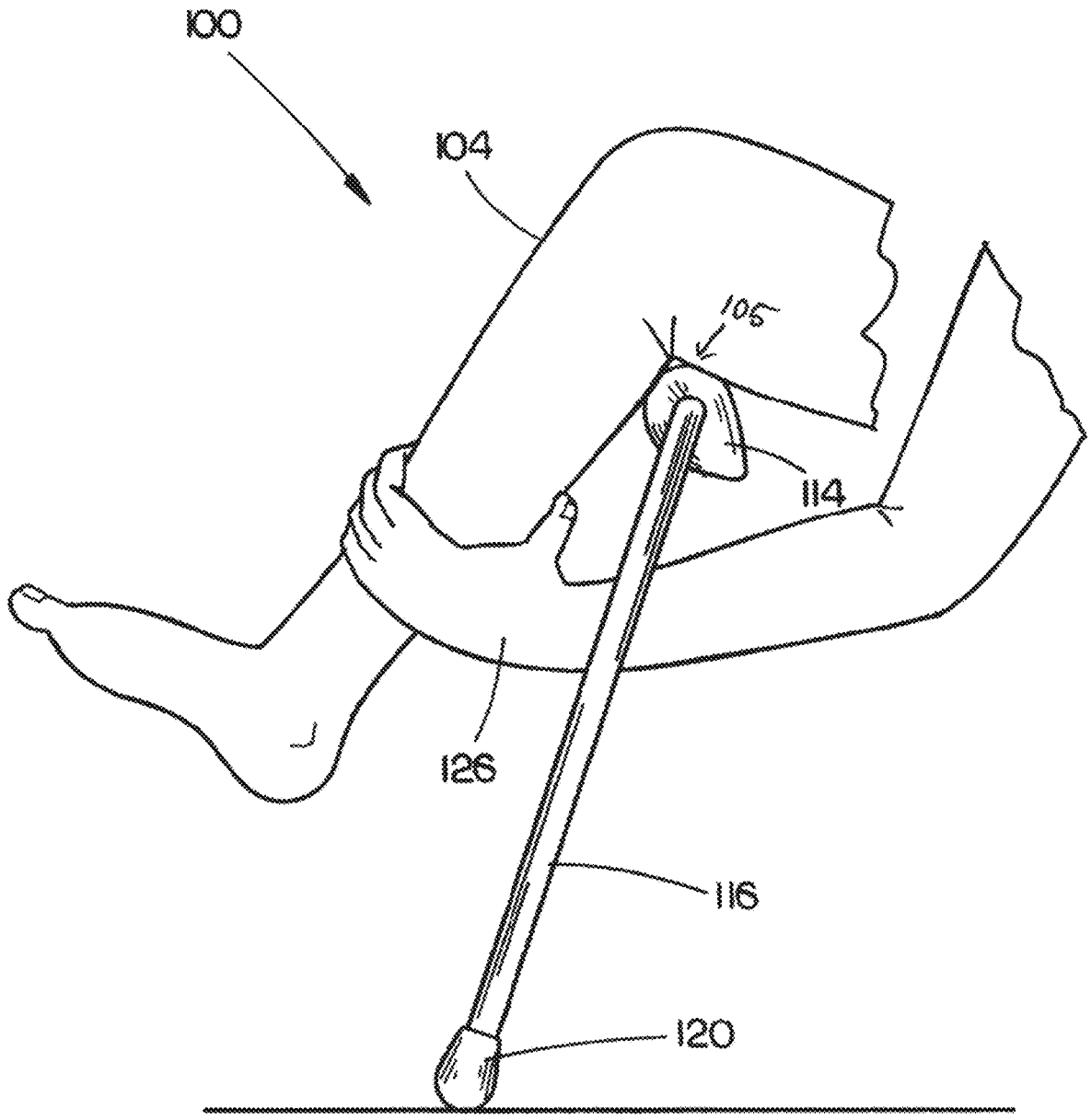
FIG. 8 is a partial side view illustrating a user directly engaging a lower portion of a treated leg of the user.

The strap 124 is included by way of example as a means of applying user force to the lower portion of the treated leg 104 to cause inward bending of the knee; however, several alternative means are known to the art. For example, the user 102 may apply force to actuate the lower portion of the treated leg 104 by engaging the lower portion of the treated leg 104 with one or both hands 126 of the user 102 and applying a force, such as a pulling force, to bend the knee of the treated leg 104 inwards, as shown in FIG. 8. Other means for engaging the lower portion of the treated leg 104 to bend the knee of the treated leg 104 inwards may include, but are not limited to, a rag or cloth, a rigid or elastic belt, a rope, a rigid structure configured to cradle the lower portion of the treated leg, or any other suitable means known to the art.

Figure 9:
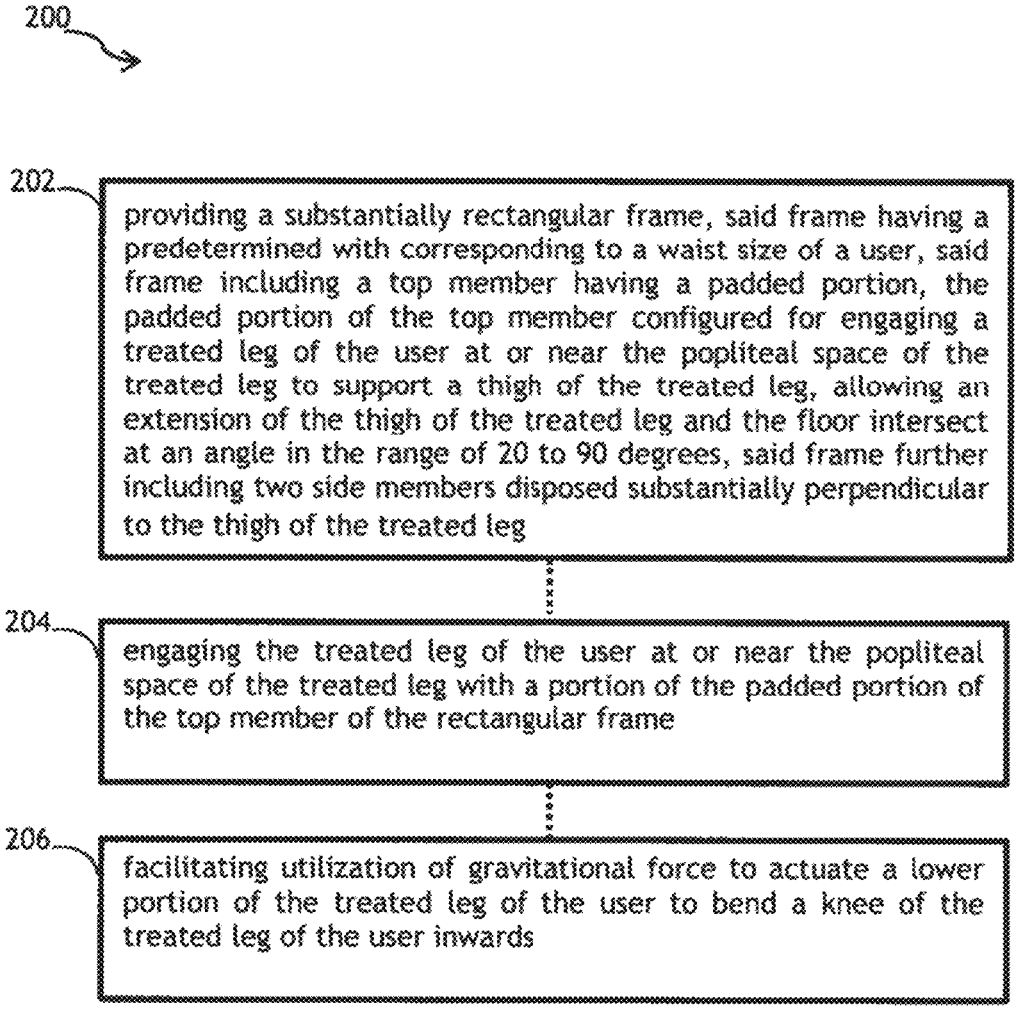
FIG. 9 is a flow diagram illustrating a method for improving knee mobility after medical treatment for injury or disease.
Figure 10:
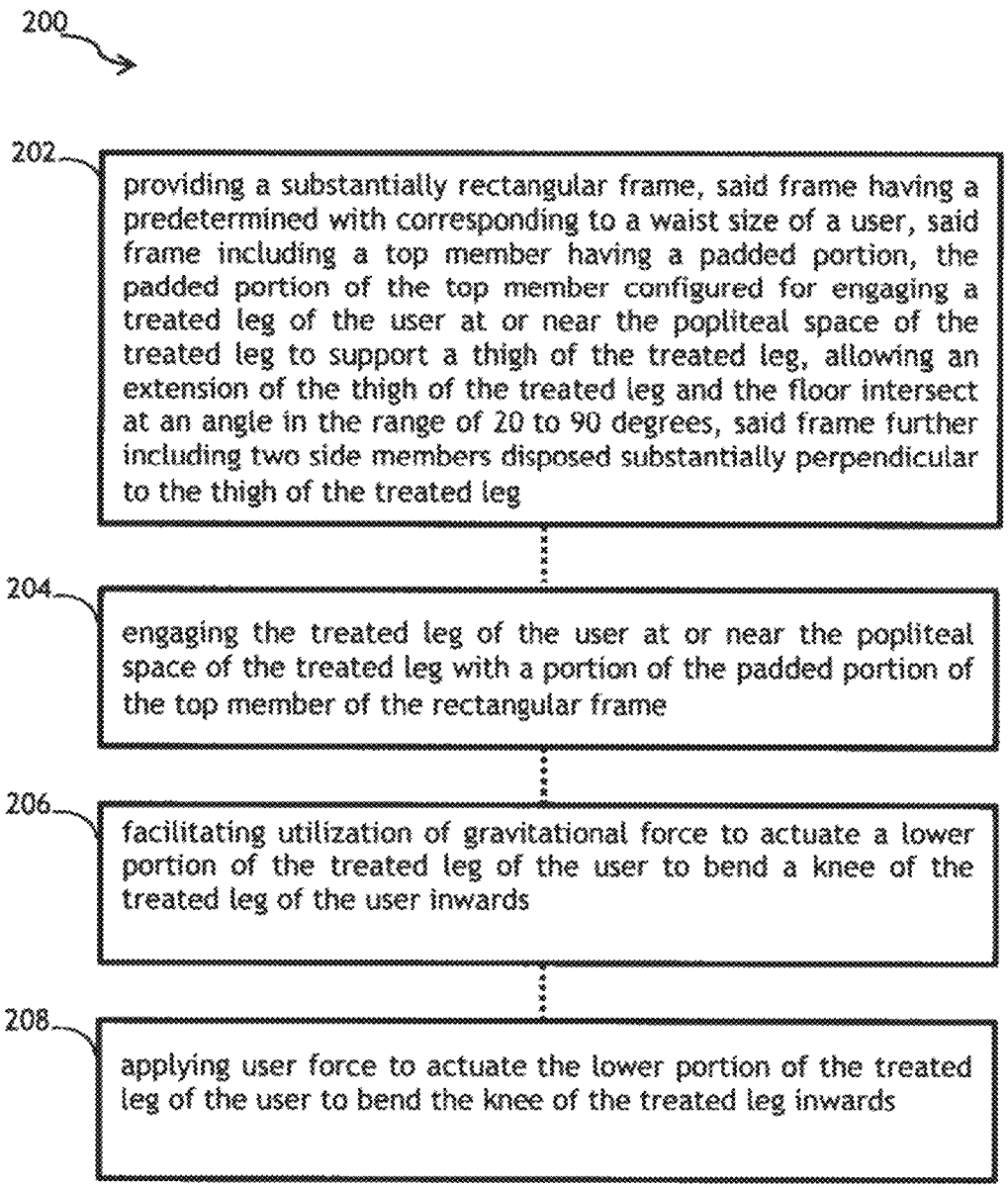
FIG. 10 is a flow diagram illustrating a method for improving knee mobility after medical treatment for injury or disease.

FIGS. 9 and 10 illustrate a method 200 of improving knee mobility of the treated leg 104 of the user 102 in accordance with system 100. It is noted herein that method 200 may be carried out to improve knee mobility of the treated leg 104 of the user 102 by the user 102 alone. Alternatively, another person may aid the user in carrying out one or more steps of method 200. It is further noted herein that one or more of the following steps may be excluded, additional steps may be included, and steps may be rearranged for method 200 without departing from the present disclosure.

Method 200 may include a step 202 of providing the frame 110 for the user 102 to engage in physical therapy exercises to improve knee mobility of the treated leg 102. It is further contemplated that step 202 of providing the frame 110 should not be limited to the field of physical therapy exercises and could alternatively be extended to fields of athletic training or health maintenance, wherein the frame 110 may be similarly utilized to simply stretch or to improve or maintain knee mobility of one or both of the user's legs.

Method 200 may further include a step 204 of engaging the treated leg 104 at or near the popliteal space 105 of the treated leg 104 of the user 102 with the top member 112 of the frame 110. In one embodiment, step 204 may further include engaging the treated leg 104 at or near the popliteal space 105 of the treated leg 104 with the padded portion 114 of the top member 112 for improved comfort and/or traction.

Method 200 may further include a step 206 of facilitating the use of gravitational force to actuate the lower portion of the treated leg 104 so that the knee of the treated leg 104 is caused to bend inwards. Step 206 may be implemented by engaging the treated leg 104 at or near the popliteal space 105 of the treated leg 104 with the frame 110 and aligning the frame 110 so that the lower portion of the treated leg 104 hangs limply extended beyond the frame 110. In addition, supporting the knee of the treated leg 104 at an elevation so that the thigh of the treated leg 104 is positioned at an angle from the floor may better facilitate utilization of gravitational force to actuate the lower portion of the treated leg 104 to bend the knee of the treated leg 104 inwards (i.e. enhance knee flexion).

In a further embodiment, shown in FIG. 10, method 200 may include a step 208 of applying user force to further actuate the lower portion of the treated leg 104 so that the knee may be bent inwards further. For example, the user force may be applied directly by the user 102 by engaging the lower portion of the treated leg 104 with one or both of the user's hands 126 and applying force to actuate the lower portion of the treated leg 104 so that the knee is bent inwards as a result. Alternatively, the user may utilize a strap 124 or another actuation means to engage the lower portion of the treated leg 104 and indirectly apply user force to actuate the lower portion of the treated leg 104 so that the knee is bent inwards as a result. It is further contemplated that another person (e.g. therapist, physician, trainer, friend, etc.) may assist by applying a user force and/or positioning a weight to apply additional force to the lower portion of the treated leg 104 so that the knee flexes or bends inwards as a result.

In a further embodiment, outwards bending or extension of the knee may be facilitated by resting the back of the ankle on the padded portion of the frame. Gravitational force on the extended leg 104 may actuate the knee to bend outwards further. In addition, a downwards force may be applied to the thigh to force the knee to bend outwards further. In one embodiment, a weighted assembly or user force may be applied to an upper portion of the thigh. For example, the weighted assembly may include a strap having at least one weighted end, a weighted sleeve, or any relatively heavy object, such as a phonebook, gel pack, sandbag, and the like.

In one embodiment, step 208 may be included at a specified stage in physical therapy following a medical treatment for injury or disease affecting knee mobility of the user 102. For example, in a first period of time following medical treatment the user 102 may have stiffness or swelling in the knee of the treated leg 104 making inwards bending of the knee difficult. Accordingly, the user 102 may only practice step 206 of allowing gravitational force to actuate the lower portion of the treated leg 104 for therapy sessions during the first period of time following medical treatment until the stiffness or swelling is reduced. Therapy sessions may include time intervals and/or repetitions prescribed by a professional, such as a doctor, therapist, trainer, and the like. For example, the therapy sessions may include time intervals in the range of 5 minutes to 3 hours or 50 to 500 repetitions three times daily. In one embodiment, the therapy sessions may include 10 minute exercises, 3 times per day. Alternatively, the user may select a desired time interval and/or number of repetitions for a therapy session.

Exercises to enhance knee extension may be similarly directed by a professional or completed by the user as desired. The user 102 may extend the treated leg 104 utilizing the frame for prescribed or desired time intervals. For example, the user 102 may hold the treated leg 104 in an extended position utilizing the frame for 20 seconds, 10 to 50 times per day. In addition, the user 102 may supply user force and/or utilize a weight to apply additional downwards force on the thigh of the treated leg 104 to promote outwards bending (i.e. extension) of the knee. It is further contemplated that another person (e.g. therapist, physician, trainer, friend, etc.) may assist by applying a user force and/or positioning a weight to apply additional downwards force on the thigh of the treated leg 104.

In a further embodiment, the user may begin to practice step 208 of applying user force to bend the knee of the treated leg 104 inwards further as the swelling of the knee following medical treatment is sufficiently reduced. However, the user 102 may still have relatively limited mobility making it difficult for the user 102 to reach the lower portion of the treated leg 104 without the aid of a strap 124 or another means of actuating the lower portion of the treated leg 104 with an indirectly applied user force. Accordingly, the user 102 may apply an indirect user force utilizing the strap 124 or another actuation means for therapy sessions during a second period of time (e.g. 2 days to 8 weeks) until the user 102 is capable of reaching the lower portion of the treated leg 104 without having to put undue strain upon the user's back. For example, the user 102 may eventually be able to reach the lower portion of the treated leg 104 without bending the user's back significantly from a substantially upright position.

Thereafter, the user 102 may begin applying direct user force using one or both hands to actuate the lower portion of the treated leg 104 for therapy sessions. The user may continue to apply direct user force to actuate the lower portion of the treated leg 104 for therapy sessions for a remainder of the total physical therapy. For example, the user may apply direct user force to actuate the lower portion of the treated leg for a specified third period of time (e.g. 2 to 12 weeks) or as long as the user 102 or the prescribing professional desires.

Figure 11:
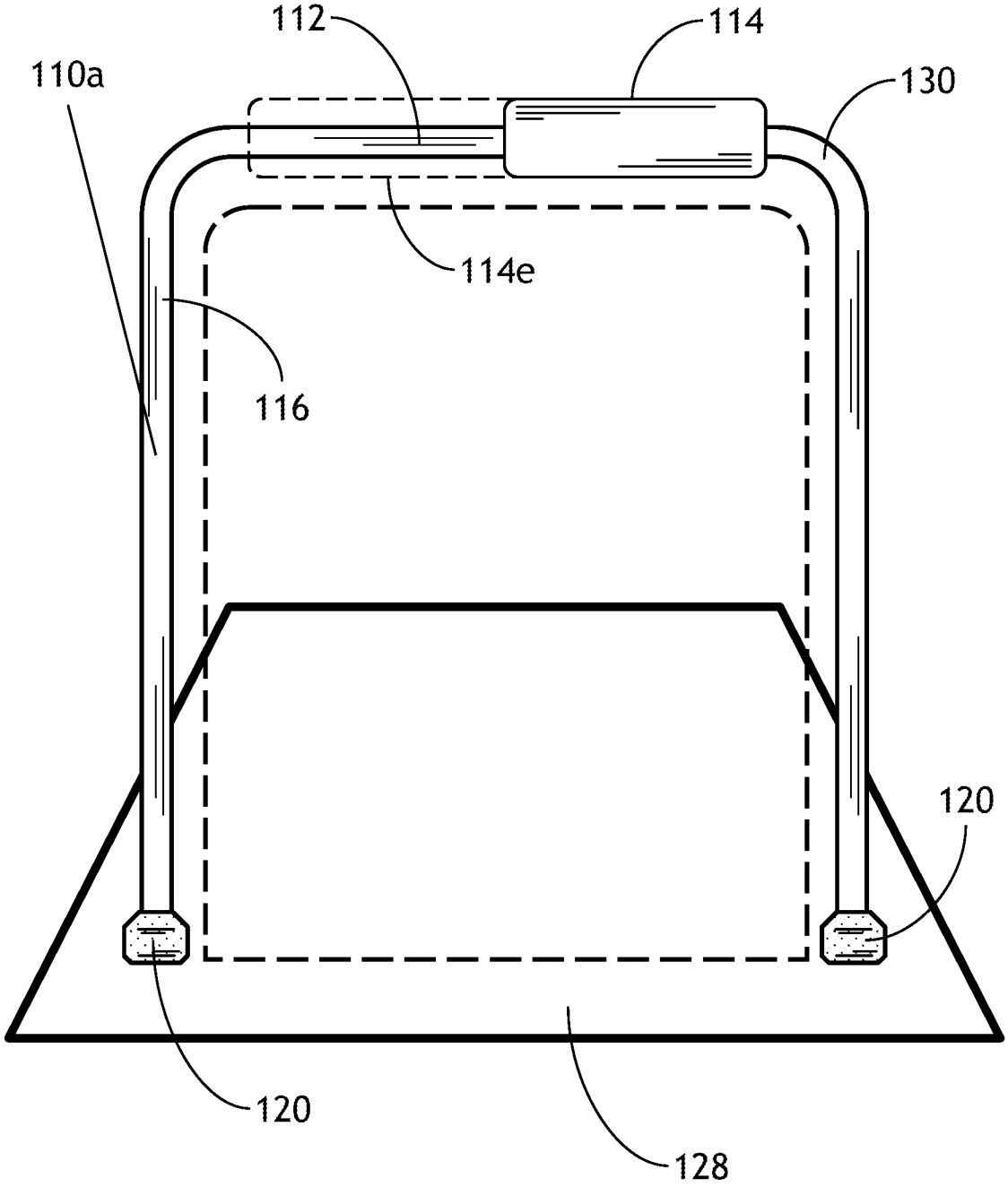
FIG. 11 is a forward view of the system illustrated in FIG. 1.

Referring to FIG. 11, the frame 110*a* may be implemented and may function similarly to the frame 110 shown by FIGS. 1, 3, and 4, except that the frame 110*a* may provide structural support via reinforced or tubular side members (116) rather than a bottom member 118 (see FIGS. 1, 3, 4). For example, the substantially rectangular structure of the frame 110*a* may be formed by the top member 112, the two side members 116, and the floor (128) or flat surface upon which the system 100 is deployed. The flat surface upon which the system 100 is deployed may include the floor 128, a mat or padded/cushioned surface thereon, bed, table, or any other surface capable of supporting the user 102 (FIG. 1) as described above. The side members 116 may terminate in bases (120). Other than through the top member 112 and side members 116, the left-side and right-side bases 120 may not otherwise be connected to each other. Similarly, the frame 110*a* may incorporate curved or rounded transitions (130) between the top member 112 and side members 116 (resulting in a rounded rectangular frame) without affecting the alignment of the top member or its engagement with the treated leg (104, FIG. 1) at or near the popliteal space (105, FIG. 1) via the padded portion 114. As noted above, the padded portion 114 may extend across a portion of the top member 112, translatable across the top member, or the padded portion may extend substantially fully (114*e*) across the top member (e.g., between curved transition points 130 whereby the top member transitions into the side members 116). The frame 110*a* may be employed by the user 102 to provide any combination of passive force (e.g., gravitational force), user-assisted force (e.g., provided by another person, e.g., a therapist, physician, trainer, friend) and user-directed force (provided by the user himself or herself, e.g., via a strap 124, FIGS. 5-6 or a hand 126, FIG. 8) to actuate the knee of the treated leg 104.

Figure 12:
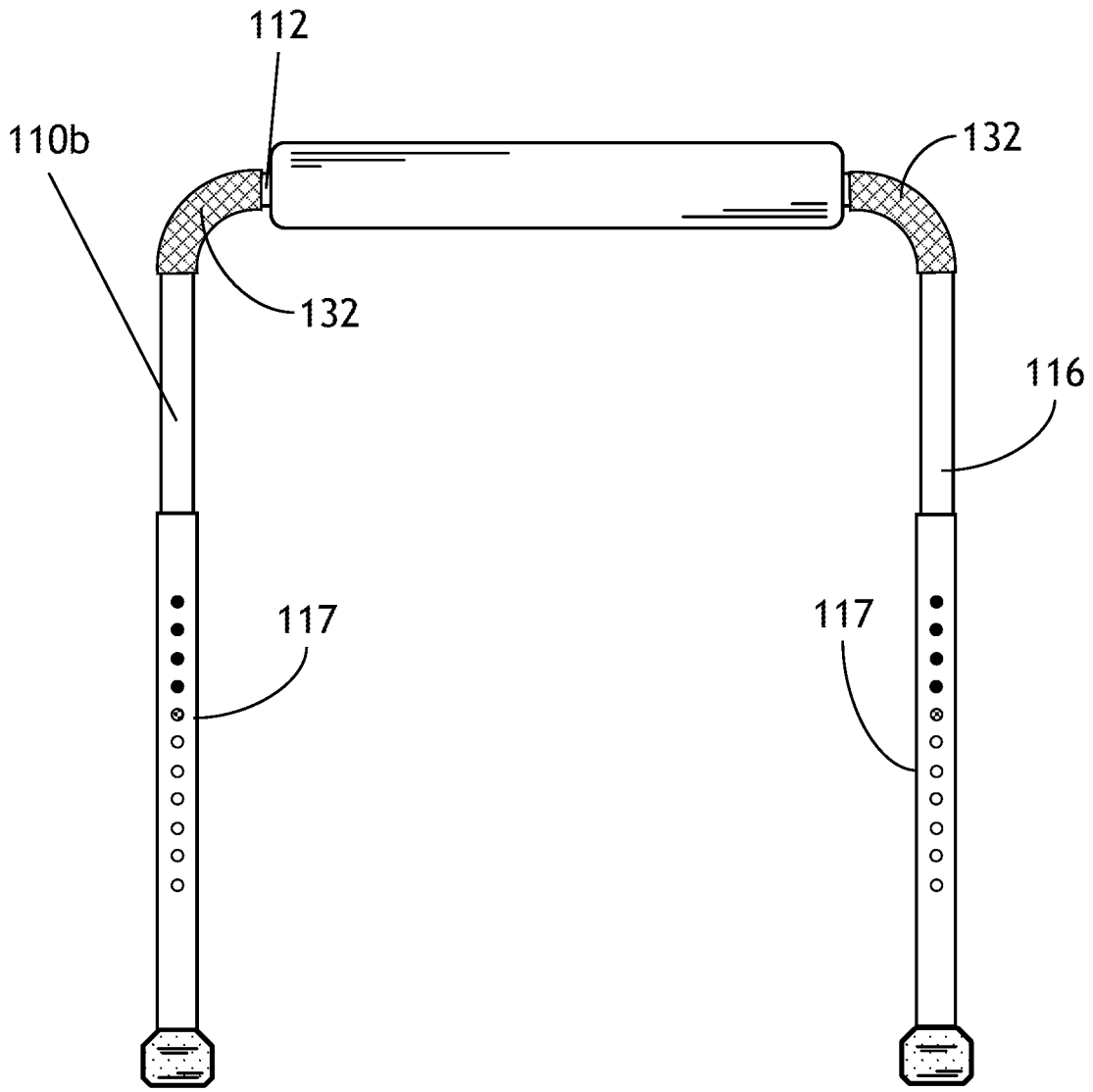
FIG. 12 is a forward view of the system illustrated in FIG. 11.

Referring to FIG. 12, the frame 110*b* may be implemented and may function similarly to the frame 110*a* of FIG. 11, except that the frame 110*b* may include rubberized or textured grips (132) removably attached to the frame. The grips 132 may be attached (e.g., by wrapping or fastening) to the curved transitions (130, FIG. 11) between the top member 112 and side members 116. The grips 132 may be used (e.g., by the hands (126, FIG. 8) of the user) to position or stabilize the frame 110*a*, e.g., for adjusting or positioning the system in preparation for or during use (from either a seated, supine, or standing position), or for adjusting the height of the frame 110*b* via telescopic segments 117 of the side members 116. As described above, the height of the frame 110*b* may gradually be increased over time to increase the range of flexibility and motion available to the knee or hip of the treated leg 104 (FIG. 2). For example, in the initial stages of rehabilitation the frame 110*b* may be set at a height to allow a 70-80 degree range of motion relative to the upper portion of the treated leg 104 (see, e.g., FIG. 2). As the knee gains strength, the height of the frame 110*b* may be increased to allow the knee to flex through a range of 90 degrees or greater.

Referring to FIGS. 13A through 13E, the padded portions 114*f-j* may be implemented and may function similarly to the padded portions 114, 114*a-e* (FIGS. 1, 3, 11), except that the padded portions 114*f-j* may incorporate an inner core (114*k*) or inner layer (134) (e.g., proximate to engagement with the top member 112, FIG. 12) having a higher degree of stability or rigidity, or a lower degree of deformability, than the exterior of the padded portion (e.g., proximate to engagement with the treated leg 104, FIG. 1). For example, referring in particular to FIG. 13A, the inner core 114*k* may have a substantially round (or cylindrical, extending along a portion of the top member 112) shape, or a shape substantially contouring to the exterior of the padded portion 114*f* (see, e.g., the triangular, oval, and part-circle padded portions 114*a*, 114*b*, 114*d*, FIG. 3).

Figure 13A:
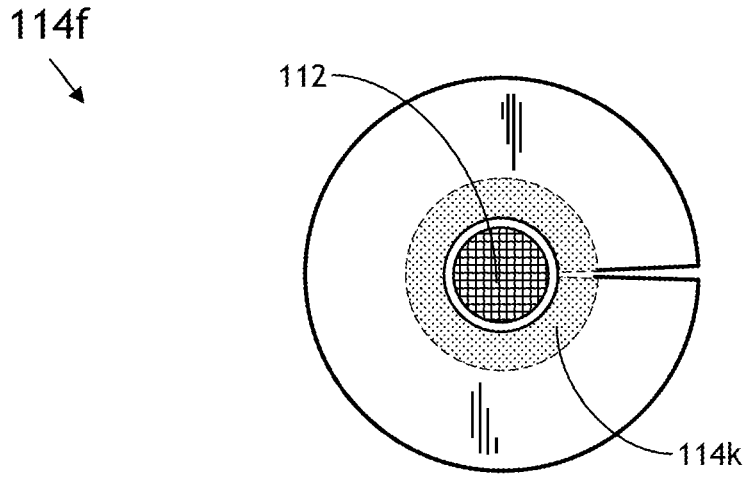
FIGS. 13A through 13E are cross-sectional views of the padded portion illustrated in FIG. 12.
Figure 13B:
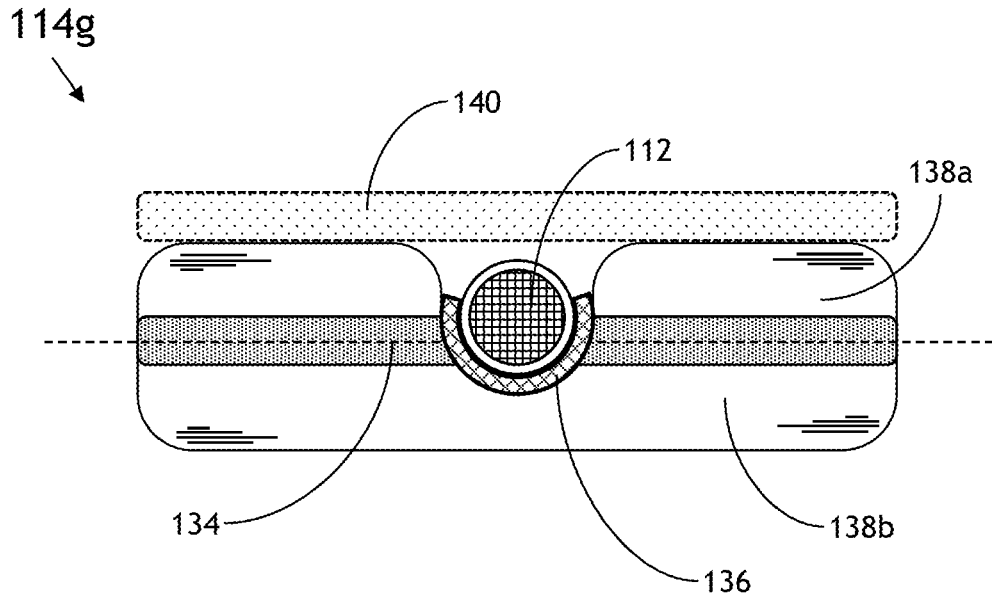
Figure 13C:
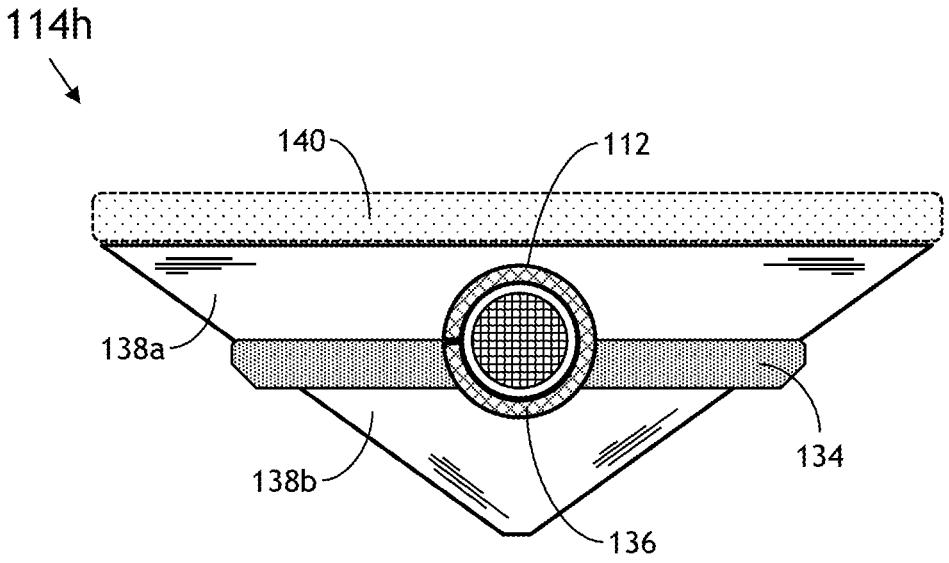
Figure 13D:
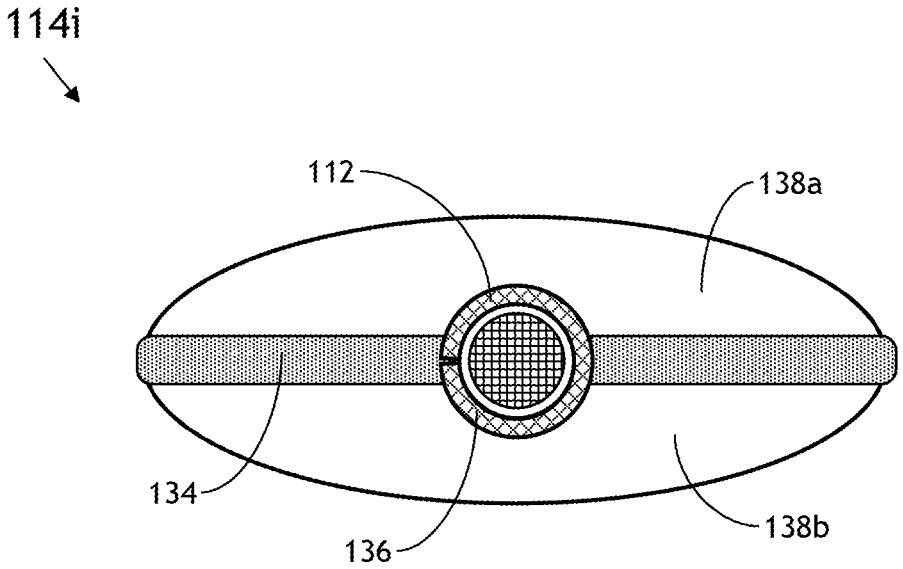
Figure 13E:
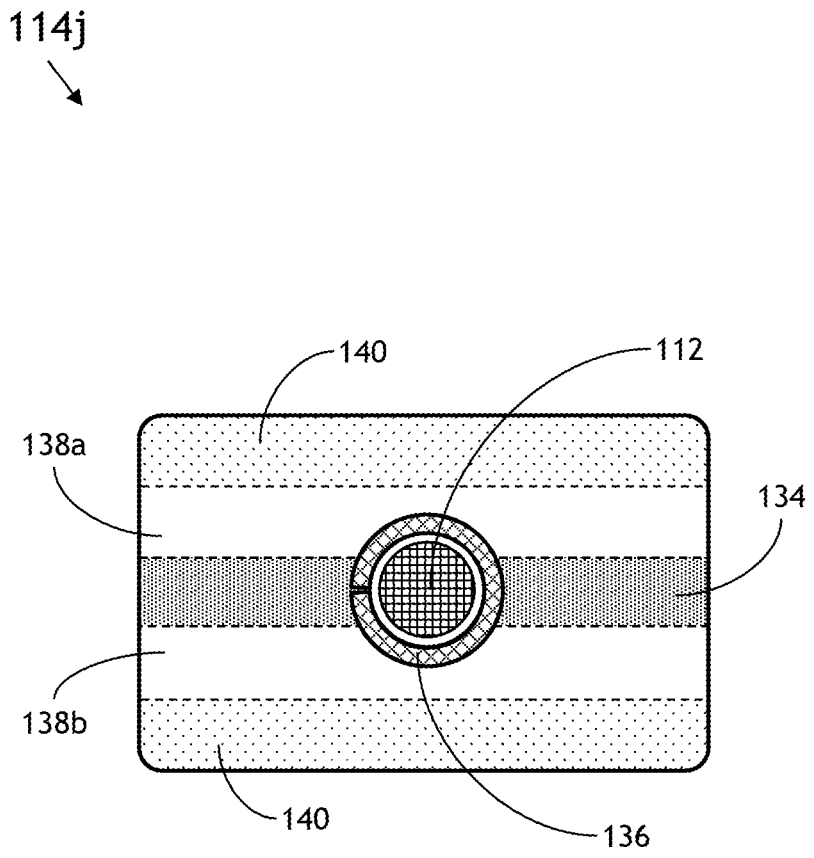

Referring in particular to FIGS. 13B through 13D, the padded portions 114*g-i* may be attached to a bearing (136) that is in turn attachable around the circumference of the top member 112. The bearing 136 may extend partially around the top member 112, as shown by the padded portion 114*g* of FIG. 13B, or fully around the top member 112, as shown by the padded portions 114*h-i* of FIGS. 13C-D. The rigid inner layer 134 of the padded portions 114*g-i* may be fashioned from PVC, carbon fiber, metal, plastic, other solid materials having a tubular structure, or any like material having a greater structural integrity and rigidity, and a lower degree of deformability, than the external padded portion. The padded portions 114*g-i* and inner layer 134 may comprise two pieces fitted together around the bearing 136 (and, for example, upper and lower external pads 138*a-b*). The inner layer 134 may serve to elongate the padded portions 114*g-j*, extending substantially parallel to the thigh of the treated leg (122, FIG. 2) and supporting the thigh. Additional protective padding or covering (140) may be removably attached to the padded portions 114*g-i* between the inner layer 134 and the treated leg (104, FIG. 2). The padded portions 114*g-i* may extend fully or partially along the top member 112 (see, e.g., FIG. 11) and may be of any appropriate shape in cross section, e.g., circular, oval, rectangular, semicircular, triangular, trapezoidal. Referring in particular to FIG. 13E, the padded portion 114*j* may be implemented and may function similarly to the padded portions 114*g-i* of FIGS. 13B-D, except that the padded portion 114*j* may have a layered structure comprising the rigid inner layer 134 and less rigid outer layers (138*a-b*) and/or protective layers (140), such that the padded portion 114*j* may be deployed with either protective layer 140 between the rigid inner layer 134 and the treated leg (104, FIG. 2).

Figure 14:
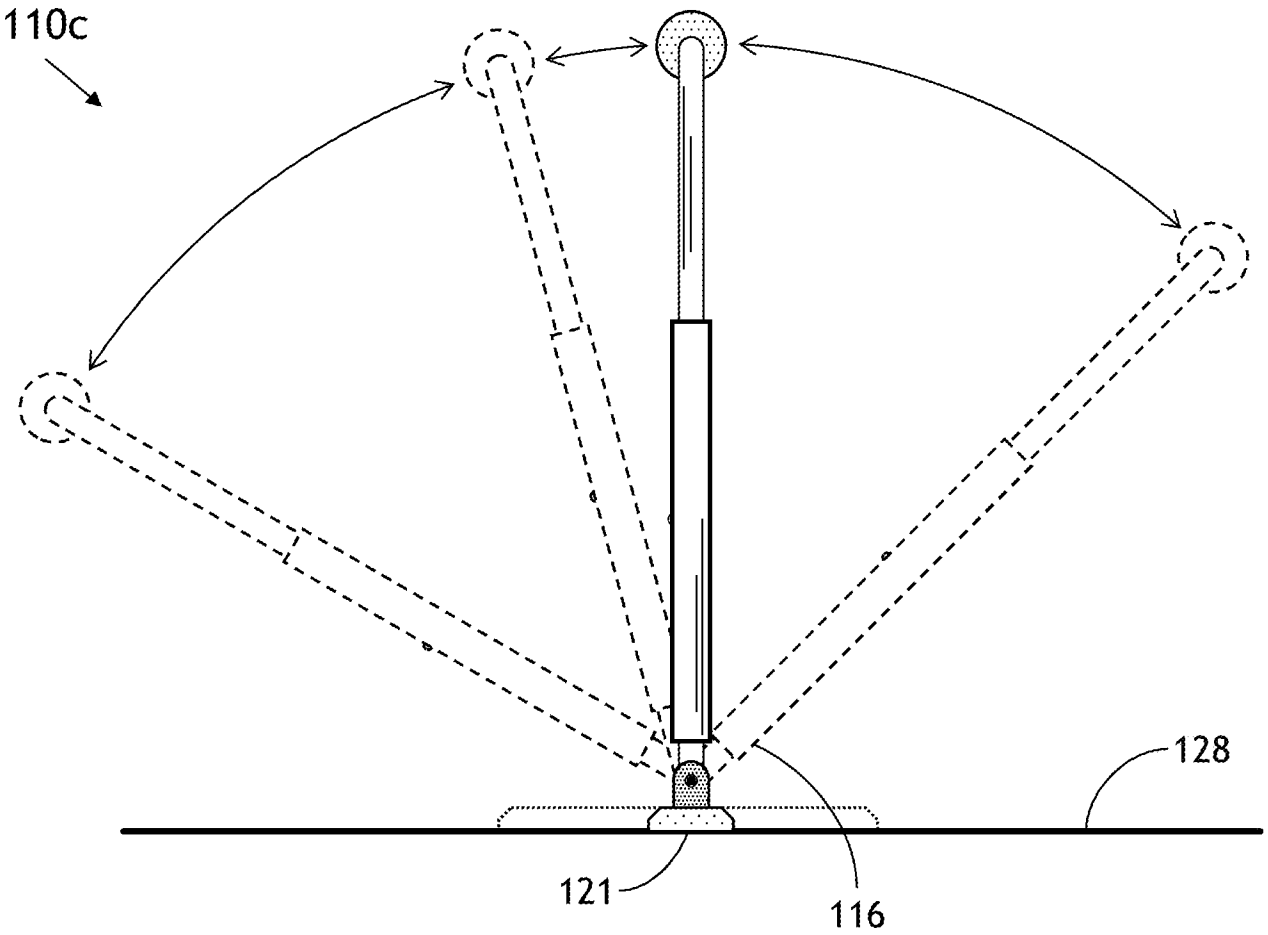
FIG. 14 is a side view of the system illustrated in FIG. 12.

Referring to FIG. 14, the frame 110*c* may be implemented and may function similarly to the frames 110*a-b* of FIGS. 11 and 12, except that the side members 116 of the frame 110*c* may terminate in hinged bases 121. For example, the left side member may terminate in a left-side hinged base and the right-side member in a right-side hinged base. The hinged bases 121 may allow the side members 116 to pivot through a plurality of angles (e.g., while maintaining a substantially rectangular form in combination with the floor 128) while the hinged bases 121 remain in flat contact with the floor. In some embodiments, the hinged bases 121 may enable the side members 116 to lock into a desired position relative to the floor 128. The hinged bases 121*a* may be implemented and may function similarly to the hinged bases 121, except that the hinged bases may extend along the floor 128 for sufficient length so as to allow the frame 110*c* to remain upright, with the side members 116 pivoted to the desired angle, without additional support.

Figure 15:
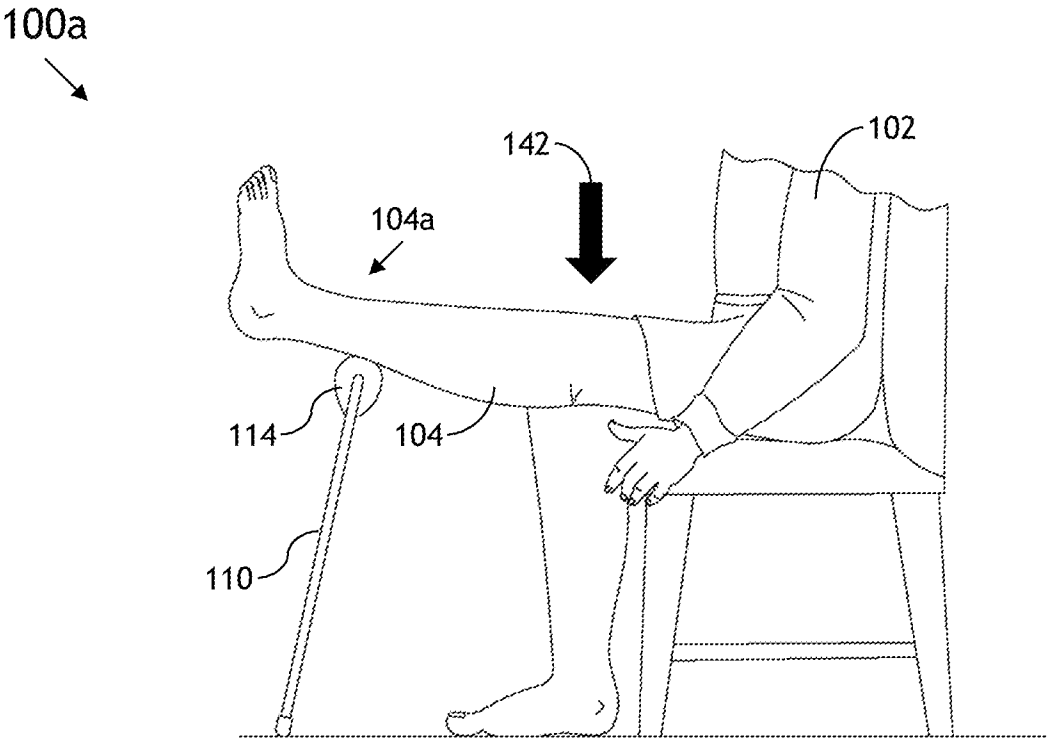
FIG. 15 is a side view of operations of the system illustrated in FIGS. 1 and 12.

Referring to FIG. 15, the system 100*a* may be implemented and may function similarly to the system 100 of FIG. 1, except that the system 100*a* may be employed, as described above, for exercises to enhance outward extension of the knee. For example, the user 102 may extend the treated leg to engage the frame 110 (110*a*, FIGS. 11-12) via the padded portion 114 proximate to the lower portion or ankle (104*a*) of the treated leg 104, holding the treated leg in an extended position as described above. In addition, the user 102 (or another person, e.g., a therapist, physician, trainer, friend) may provide a downward force (142) or weight on the thigh of the treated leg 104 to promote outward bending or extension of the knee as described above.

Figure 16:
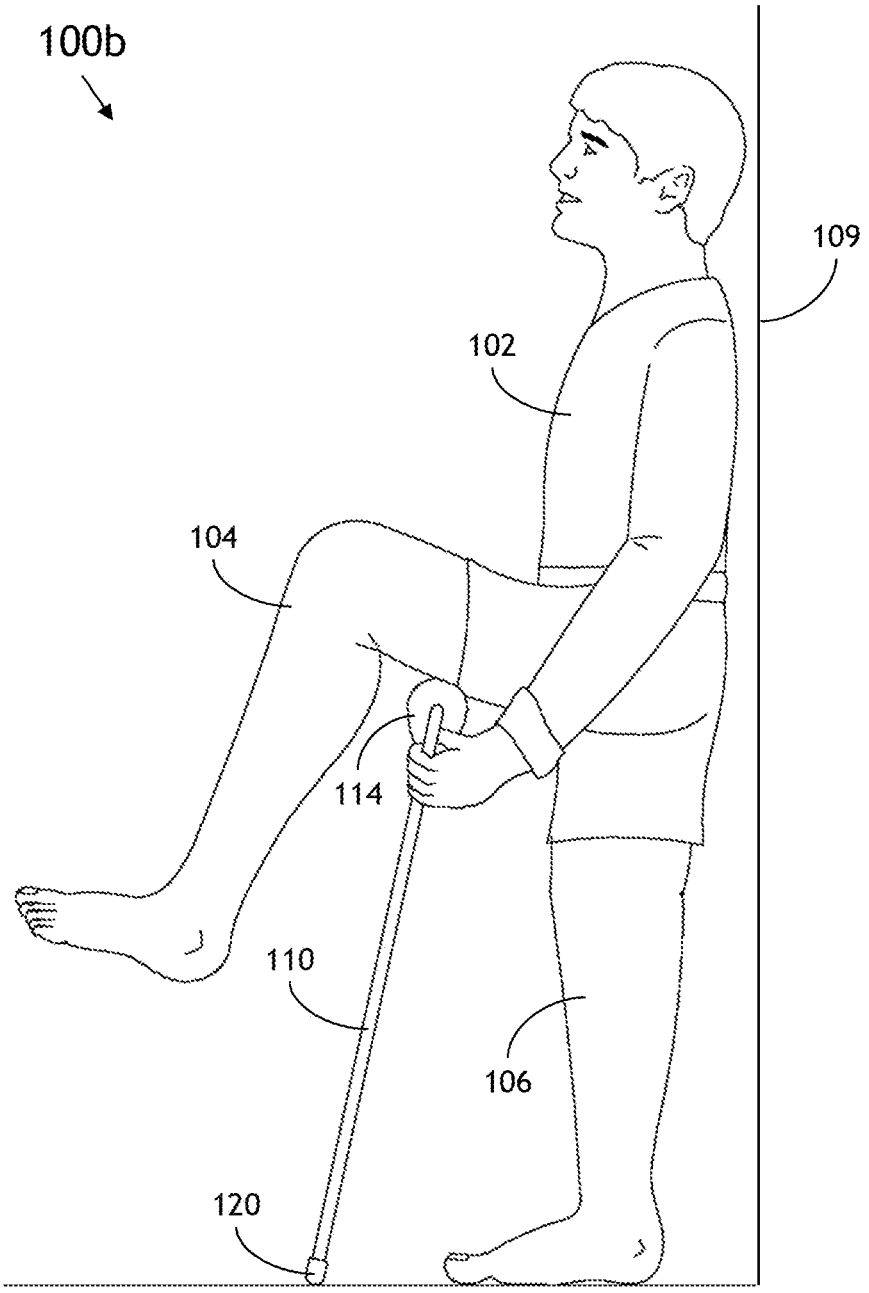
FIG. 16 is a side view of operations of the system illustrated in FIGS. 1 and 12.

Referring to FIG. 16, the system 100*b* may be implemented and may function similarly to the systems 100, 100*a* of FIGS. 1 and 15, except that the system 100*b* may be employed by a user (102) in a standing position, provided the user is capable of sufficient coordination and balance. For example, the user may engage the padded portion 114 and frame 110 (110*a*, FIGS. 11-12) with the treated leg 104. The frame 110/110*a* may be supported in place by the bases 120, while the user 102 may be supported by the non-treated leg (106) and a vertical support mechanism (109) such as a wall or corner where two walls intersect.

Figure 17:
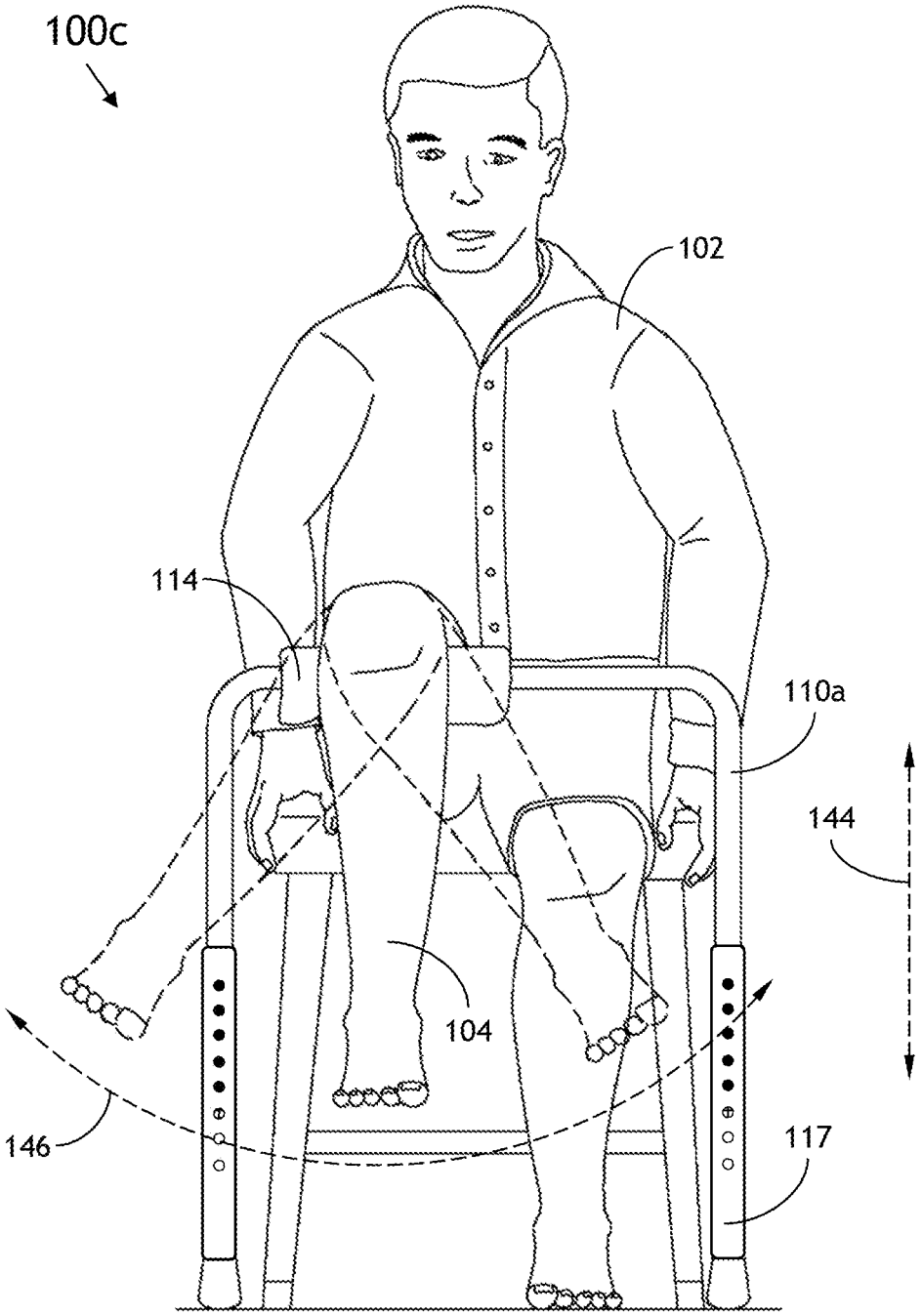
FIG. 17 is a forward view of operations of the system illustrated in FIGS. 1 and 12.

Referring to FIG. 17, the system 100*c* may be implemented and may function similarly to the systems 100, 100*a*, and 100*b* of FIGS. 1, 15, and 16 respectively, except that the system 100*c* may be implemented by the user 102 for exercises enhancing the mobility of a hip of the treated leg 104. For example, the user 102 (e.g., from a seated, supine, or standing position) may engage the frame 110/110*a* via the padded portion 114, allowing gravitational force to act upon the lower portion of the treated leg 104 extending beyond the padded portion 114. The user 102 may then exercise the hip of the treated leg 104 through a vertical range of motion (144) and/or a rotational range of motion (146), while the treated leg is supported by the frame 110/110*a*. The height of the frame 110*a* may be increased (e.g., via telescopic segments 117) to increase the vertical range of motion 144 available to the hip of the treated leg 104.

It is noted herein that the foregoing examples relating to time periods and or other numerical boundaries are included for illustrative purposes only and should not be construed to limit the present disclosure in any way. It is contemplated that users having different ailments or goals may utilize the system 100 in a manner and time period suitable for the results they desire. Accordingly, the illustrative examples and embodiments disclosed herein should be understood to extend to treatments or therapies that may be unique to the user 102.

In the present disclosure, it should be understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

I claim:

1. A system for knee rehabilitation, comprising:

a rigid frame consisting of a top member and two reinforced side members including a left side member and a right side member, wherein each of the side members terminate in a base and each base terminates in a free end, each side member extending in a straight linear fashion between a first end and its respective base, the side members connected solely by the top member extending in a straight linear fashion between the first ends, the top member arranged in a same plane with, and substantially perpendicular to, the two side members;

the top member at least partially covered by a padded portion attached thereto, the padded portion configured to engage a treated leg of a user in a seated position above a floor at or near a rear popliteal space to support a knee of the treated leg in a raised position;

and wherein each side member includes a transition between the top member and each first end of each side member, each transition including a rubberized grip, each grip being configured for allowing the user to stabilize or position the frame relative to the floor using a hand;

the bases configured to:

1) Provide traction between the side members and the floor;

2) Pivot the side members through a plurality of angles relative to the floor;

and 3) position the side members substantially perpendicular to a thigh of the treated leg;

thus enabling the frame to induce the knee to bend inwards or outwards in response to one or more of gravitational force, user-assisted force, or user-directed force affecting a lower portion of the treated leg.

2. The system of claim 1, wherein each of the transitions is a rounded transition.

3. The system of claim 1, further comprising:

a strap configured to:

engage the lower portion of the treated leg;

and actuate the lower portion of the treated leg to bend the knee inwards in response to the user-directed force applied to the strap.

4. The system of claim 1, wherein the padded portion is further configured to:

engage a portion of the treated leg proximate to an ankle;

and support the ankle at an elevation allowing the one or more of gravitational force, user-assisted force, or user-directed force to induce extension of the knee of the treated leg.

5. The system of claim 1, wherein the padded portion is attached to the top member via at least one bearing, the bearing extending at least partially along the top member.

6. The system of claim 5, wherein the bearing at least partially encloses the top member.

7. The system of claim 1, wherein the padded portion is translatable to a plurality of positions along the length of the top member.

8. The system of claim 1, wherein the padded portion of the top member comprises a deformable material.

9. The system of claim 8, wherein the padded portion comprises:

at least one inner layer substantially aligned with the thigh, the inner layer having a first deformability;

and at least one outer layer disposed between the treated leg and the inner layer, the outer layer having a second deformability greater than the first deformability.

10. The system of claim 1, wherein the height of the frame is adjustable thus enabling the frame to induce the knee to bend inwards or outwards through a range of motion based on the height of the frame.

11. The system of claim 1, wherein the frame is collapsible.

12. A method for improving knee mobility, comprising:

supporting a user proximate to a flat surface in a seated position above the flat surface, the seated position associated with alleviating pressure on a spine of the user;

providing a rigid frame to support a thigh of a treated leg of the user, the rigid frame consisting of:

a top member and two reinforced side members including a left side member and a right side member, wherein each of the side members terminate in a base and each base terminates in a free end, each side member extending in a straight linear fashion between a first end and its respective base, the side members connected solely by the top member extending in a straight linear fashion between the first ends, the top member arranged in a same plane with, and substantially perpendicular to, the two side members, the top member at least partially covered by a padded portion configured to engage the treated leg at or near a popliteal space to support a knee of the treated leg in a raised position, the bases being configured to provide traction between the side members and the flat surface and to allow the side members to pivot through a plurality of angles relative to the flat surface;

and wherein each side member includes a transition between the top member and each first end of each side member, each transition including a rubberized grip, each grip being configured for allowing the user to stabilize or position the frame relative to the flat surface using a hand;

positioning the side members substantially perpendicular to a thigh of the treated leg;

engaging the treated leg at or near the popliteal space via the padded portion;

and facilitating utilization of one or more of gravitational force, user-assisted force, or user-directed force to actuate at least one lower portion of the treated leg to bend the knee inwards through a range of motion.

13. The method of claim 12, wherein facilitating utilization of one or more of gravitational force, user-assisted force, and user-directed force to actuate at least one lower portion of the treated leg to bend the knee inwards includes:

engaging the at least one lower portion via a handheld strap held by the user.

14. The method of claim 12, further comprising:

increasing range of motion of the treated leg by lengthening the side members to increase a height of the top member relative to the flat surface.

15. A method for improving knee mobility, comprising:

supporting a user proximate to a flat surface in a seated position above the flat surface, the seated position associated with alleviating pressure on a spine of the user;

providing a rigid frame to support a thigh of a treated leg of the user, the rigid frame consisting of:

a top member and two reinforced side members including a left side member and a right side member, wherein each of the side members terminate in a base and each base terminates in a free end, each side member extending in a straight linear fashion between a first end and its respective base, the side members connected solely by the top member extending in a straight linear fashion between the first ends, the top member arranged in a same plane with, and substantially perpendicular to, the two side members, the top member at least partially covered by a padded portion configured to engage the treated leg at or near an ankle, the bases being configured to provide traction between the side members and the flat surface and to allow the side members to pivot through a plurality of angles relative to the flat surface;

and wherein each side member includes a transition between the top member and each first end of each side member, each transition including a rubberized grip, each grip being configured for allowing the user to stabilize or position the frame relative to the flat surface using a hand;

positioning the side members substantially perpendicular to a thigh of the treated leg;

engaging the treated leg at or near the ankle via the padded portion; and facilitating utilization of one or more of gravitational force, user-assisted force, user-directed force to induce extension of a knee of the treated leg.

* * * * *